US009033608B2

(12) United States Patent
Huang et al.

(10) Patent No.: US 9,033,608 B2
(45) Date of Patent: May 19, 2015

(54) RING BINDER MECHANISM HAVING DUAL TIME BUFFER ACTUATOR

(75) Inventors: Ming Hua Huang, Sui Zhou (CN); Yun Long Li, NanPanQiao Village (CN)

(73) Assignee: World Wide Stationery Mfg. Co., Ltd. (CN)

( * ) Notice: Subject to any disclaimer, the term of this patent is extended or adjusted under 35 U.S.C. 154(b) by 317 days.

(21) Appl. No.: 12/826,035

(22) Filed: Jun. 29, 2010

(65) Prior Publication Data

US 2011/0170942 A1 Jul. 14, 2011

(30) Foreign Application Priority Data

Jan. 14, 2010 (CN) ..... 2010 1 0003177

(51) Int. Cl.
*B42F 13/26* (2006.01)

(52) U.S. Cl.
CPC ..... *B42F 13/26* (2013.01)

(58) Field of Classification Search
CPC ..... B42F 13/26
USPC ..... 402/38, 40–42, 31
See application file for complete search history.

(56) References Cited

U.S. PATENT DOCUMENTS

| | | | |
|---|---|---|---|
| 566,717 | A | 8/1896 | Krah |
| 651,254 | A | 6/1900 | Krah |
| 683,019 | A | 9/1901 | Buchanan |
| 790,382 | A | 5/1905 | McBride |
| 854,074 | A | 5/1907 | Bryant |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,733,548 | A | 10/1929 | Martin |

(Continued)

FOREIGN PATENT DOCUMENTS

| | | |
|---|---|---|
| CA | 2500817 A1 | 9/2005 |
| EP | 1431065 A2 | 6/2004 |

(Continued)

OTHER PUBLICATIONS

Kokuyo Lock Ring Mechanism with description, two instruction sheets, and nine photographs, undated but admitted as prior art, 12 pgs.

*Primary Examiner* — Shelley Self
*Assistant Examiner* — Matthew G Katcoff
(74) *Attorney, Agent, or Firm* — Senniger Powers LLP

(57) ABSTRACT

A ring mechanism has an elongate housing and rings for holding loose-leaf pages. Each ring has ring members mounted on pivoting hinge plates for movement between open and closed positions. An actuator has opening and closing arms extending from an actuator body for opening and closing the rings. The mechanism has a travel bar moveable between a locked position in which a locking element blocks pivoting movement of the hinge plates and an unlocked position. The actuator has a flexible arm positioned to push the travel bar toward the locked position when the actuator closes the rings. At least a portion of the flexible arm is adapted to deform during closing in a manner that includes rotation in a first direction relative to the body of the actuator. Movement of the actuator to close the rings includes rotation of the actuator in the first direction relative to the housing.

21 Claims, 30 Drawing Sheets

(56) References Cited

U.S. PATENT DOCUMENTS

| | | | |
|---|---|---|---|
| 1,733,894 | A | 10/1929 | Martin |
| 1,787,957 | A | 1/1931 | Schade |
| 1,822,669 | A | 9/1931 | Schade |
| 1,857,291 | A | 5/1932 | Trussell |
| 1,896,839 | A | 2/1933 | Dawson |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,067,846 | A | 1/1937 | Cooper |
| 2,075,766 | A | 3/1937 | Rand |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,062 | A | 4/1941 | Tallmadge |
| 2,239,121 | A | 4/1941 | St. Louis et al. |
| 2,251,878 | A | 8/1941 | Hanna et al. |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,338,011 | A | 12/1943 | Schade |
| 2,421,799 | A | 6/1947 | Martin |
| 2,528,866 | A | 11/1950 | Dawson, Jr. |
| 2,543,866 | A | 3/1951 | Panfil, Sr. |
| 2,552,076 | A | 5/1951 | Wedge |
| 2,612,169 | A | 9/1952 | Segal |
| 2,789,561 | A | 4/1957 | Bonn et al. |
| 2,865,377 | A | 12/1958 | Schroer et al. |
| 2,871,711 | A | 2/1959 | Stark |
| 2,891,553 | A | 6/1959 | Acton |
| 2,894,513 | A | 7/1959 | Gempe et al. |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,222,679 | A | 9/1980 | Luogameno |
| 4,352,582 | A | 10/1982 | Eliasson |
| 4,486,112 | A | 12/1984 | Cummins |
| 4,522,526 | A | 6/1985 | Lozfau et al. |
| 4,566,817 | A | 1/1986 | Barrett, Jr. |
| 4,571,108 | A | 2/1986 | Vogl |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,332,327 | A | 7/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,524,997 | A | 6/1996 | von Rohrscheidt |
| 5,577,852 | A | 11/1996 | To |
| 5,651,628 | A | 7/1997 | Bankes et al. |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,836,709 | A | 11/1998 | Cheung |
| 5,868,513 | A | 2/1999 | Law |
| 5,879,097 | A | 3/1999 | Cheng |
| 5,882,135 | A | 3/1999 | Ko |
| 5,895,164 | A | 4/1999 | Wu |
| 5,904,435 | A | 5/1999 | Tung |
| 5,924,811 | A | 7/1999 | To et al. |
| 5,957,611 | A | 9/1999 | Whaley |
| 5,975,785 | A | 11/1999 | Chan |
| 6,036,394 | A | 3/2000 | Cheng |
| 6,142,697 | A | 11/2000 | Williams |
| 6,146,042 | A | 11/2000 | To et al. |
| 6,155,737 | A | 12/2000 | Whaley |
| 6,203,229 | B1 | 3/2001 | Coerver |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,371,678 | B1 | 4/2002 | Chizmar |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,270,496 | B2 | 9/2007 | Morgan et al. |
| 7,275,886 | B2 | 10/2007 | Cheng |
| 7,296,946 | B2 | 11/2007 | Cheng et al. |
| 7,404,685 | B2 | 7/2008 | Cheng |
| 7,478,963 | B2 | 1/2009 | Tanaka et al. |
| 7,491,006 | B2 | 2/2009 | Whaley |
| 7,524,127 | B2 | 4/2009 | Petrie et al. |
| 7,524,128 | B2 | 4/2009 | Cheng |
| 7,530,755 | B2 | 5/2009 | Whaley |
| 7,534,064 | B2 | 5/2009 | Cheng |
| 7,549,817 | B2 | 6/2009 | Cheng et al. |
| 7,648,302 | B2 | 1/2010 | Zhang et al. |
| 7,661,898 | B2 | 2/2010 | Ng et al. |
| 7,661,899 | B2 | 2/2010 | Lin |
| 7,665,926 | B2 | 2/2010 | Cheng |
| 7,674,062 | B2 | 3/2010 | Horn |
| 7,726,897 | B2 | 6/2010 | To et al. |
| 7,731,441 | B2 | 6/2010 | Ng et al. |
| 7,748,922 | B2 | 7/2010 | Cheng |
| 8,052,343 | B2 | 11/2011 | Zhang et al. |
| 8,186,899 | B2 | 5/2012 | Ng et al. |
| 2003/0044221 | A1 | 3/2003 | To et al. |
| 2005/0201818 | A1 | 9/2005 | Cheng |
| 2005/0207826 | A1 | 9/2005 | Cheng et al. |
| 2006/0008318 | A1 | 1/2006 | Ng |

(56) References Cited

U.S. PATENT DOCUMENTS

| | | | | |
|---|---|---|---|---|
| 2006/0056906 | A1 | 3/2006 | Horn | |
| 2006/0147254 | A1 | 7/2006 | Cheng | |
| 2006/0251467 | A1 | 11/2006 | Cheng | |
| 2007/0086836 | A1 | 4/2007 | Cheng | |
| 2008/0008519 | A1 | 1/2008 | To | |
| 2008/0075526 | A1* | 3/2008 | Ng et al. | 402/29 |
| 2008/0075527 | A1 | 3/2008 | Pi et al. | |
| 2008/0124166 | A1* | 5/2008 | Zhang et al. | 402/38 |
| 2009/0060631 | A1 | 3/2009 | To et al. | |
| 2009/0110469 | A1 | 4/2009 | To et al. | |
| 2009/0110470 | A1 | 4/2009 | To et al. | |
| 2010/0166490 | A1 | 7/2010 | Cheng et al. | |
| 2011/0170942 | A1 | 7/2011 | Huang et al. | |

FOREIGN PATENT DOCUMENTS

| | | | |
|---|---|---|---|
| FR | 1336765 | A | 9/1963 |
| FR | 1346864 | A | 12/1963 |
| FR | 2221924 | | 10/1974 |
| FR | 2238332 | A5 | 2/1975 |
| GB | 837875 | | 6/1960 |
| GB | 868724 | A | 5/1961 |
| GB | 906279 | A | 9/1962 |
| GB | 952536 | A | 3/1964 |
| GB | 2231536 | A | 11/1990 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 2034289 | U | 12/1987 |
| JP | 1299095 | A | 12/1989 |
| JP | 62-189178 | U | 3/1990 |
| JP | 4120085 | U | 10/1992 |
| JP | 6171287 | A | 6/1994 |
| JP | 10217662 | A | 8/1998 |
| JP | 10329470 | A | 12/1998 |
| JP | 2004098417 | A | 4/2004 |
| WO | 2013026351 | A1 | 2/2013 |

* cited by examiner

RING BINDER MECHANISM HAVING DUAL TIME BUFFER ACTUATOR

FIELD OF INVENTION

This invention relates to a ring binder mechanism for retaining loose-leaf pages, and in particular to an improved ring binder mechanism for opening and closing ring members and for locking closed ring members together.

BACKGROUND OF THE INVENTION

Ring binder mechanisms retain loose-leaf pages on rings. Ring binder mechanisms can be used in notebooks, files, briefcases, clipboards and other similar objects to give the object a loose-leaf page retaining function. A conventional ring binder mechanism has rings formed by ring members that are selectively moveable to open the rings to add and/or remove loose leaf pages and close the rings to retain loose-leaf pages on the rings. The ring members are commonly mounted on adjoining hinge plates supported by a housing for pivoting movement between open and closed positions. The undeformed housing is slightly narrower than the combined width of the hinge plates such that the housing applies a spring force that biases the ring members against movement toward the open position when they are in the closed position. If this spring force is strong, there is a risk that a user could be injured by getting a finger pinched between the ring members as the housing causes them to snap shut during closing. Thus, it is desirable to design the housing so it exerts a relatively light spring force on the ring members to reduce the risk of injury to users.

However, the absence of a strong biasing force holding the ring members in the closed position increases the risk that the rings will inadvertently open (e.g., if the ring mechanism is accidentally dropped) and fail to retain loose-leaf pages. One way to reduce the risk the rings will inadvertently open is to provide a locking system that blocks pivoting movement of the ring members from the closed position to the open position. It is desirable for the locking system to automatically lock the rings closed when the rings are moved to the closed position. It is also desirable to be able to unlock and open the rings in a single step to make the ring mechanism convenient to use.

United States Pub. App. No. 20080124166, which is commonly owned with the present application, discloses a ring mechanism having an actuator operable to engage the hinge plates and move the rings between the open and closed positions. The mechanism also includes a travel bar having a locking element connected to the actuator so the actuator can move the travel bar and locking element between a locking and unlocking position as the actuator moves the rings between the open and closed position.

The actuator in the '166 application is designed to deform during opening and closing to sequence movement of the travel bar (and its locking element) with movement of the hinge plates. During use of the actuator to open the rings, the actuator deforms to delay movement of the hinge plates from movement of the travel bar and locking element so the travel bar and locking element can be moved away from the locking position before the actuator moves the hinge plates to open the rings. During use of the actuator to close the rings, the actuator deforms to delay movement of the travel bar and locking element from movement of the hinge plates so the hinge plates can move to the closed position before the actuator moves the locking element into the locking position. This allows a user to unlock and open the rings in a single movement of the actuator. It also allows a user to close and lock the rings in a single movement of the actuator.

FIGS. 15-18 of the present application illustrate the closing action of the actuator in the '166 application. As illustrated, the travel bar 45 is connected to the actuator 15 by an intermediate connector 67 having ends 68*a*, 68*b* that are inserted into an opening in a flexible arm 38 (FIG. 15) on the actuator 15. FIG. 17 shows the configuration of the actuator 15 when the rings are open and FIG. 18 shows the configuration of the actuator during movement of the actuator to close the rings. As illustrated in FIG. 18, the flexible arm 38 deforms during closing by bending in a direction (e.g., clockwise in FIG. 18) relative to the rest of the actuator that is opposite the direction (e.g., counterclockwise in FIG. 18) in which the actuator rotates during use of the actuator to close the rings. This deformation of the flexible arm 18 delays movement of the travel bar 45 from movement of the hinge plates during closing.

SUMMARY OF THE INVENTION

One aspect of the invention is a ring mechanism for holding loose-leaf pages. The mechanism has an elongate housing. The mechanism also has rings for holding the loose-leaf pages. Each ring includes a first ring member and a second ring member. The first ring members are movable relative to the housing and the second ring members between a closed position and an open position. In the closed position the first and second ring members form a substantially continuous, closed loop for allowing loose-leaf pages retained by the rings to be moved along the rings from one ring member to the other. In the open position the first and second ring members form a discontinuous, open loop for adding or removing loose-leaf pages from the rings. The mechanism has first and second hinge plates supported by the housing for pivoting motion relative to the housing. The first ring members are mounted on the first hinge plate and moveable with the pivoting motion of the first hinge plate between the closed and open positions. An actuator is moveable relative to the housing to cause the pivoting motion of the hinge plates. The actuator is moveable between a first position in which the ring members are in the closed position and a second position in which the ring members are in the open position. The actuator has: (i) a body; (ii) a closing arm extending from the body and positioned to pivot the hinge plates and move the rings to the closed position when the actuator moves from the second position to the first position; and (iii) an opening arm extending from the body and positioned to pivot the hinge plates and move the rings to the open position when the actuator moves from the first position to the second position. The mechanism also has a travel bar including a locking element. The travel bar is moveable between a locked position in which the locking element blocks pivoting movement of the hinge plates to move the rings from the closed position to the open position and an unlocked position in which the locking element permits pivoting movement of the hinge plates to open the rings. The actuator has a flexible arm positioned to push the travel bar toward the locked position when the actuator moves from the second position to the first position. At least a portion of the flexible arm is adapted to deform when the actuator is moved from the second position to the first position in a manner that includes rotation of the portion of the flexible arm in a first direction relative to the body of the actuator. Movement of the actuator from the second position to the first position also includes rotation of the actuator in this first direction relative to the housing.

Another aspect of the invention is a ring mechanism for holding loose-leaf pages. The mechanism has elongate housing and rings for holding the loose-leaf pages. Each ring includes a first ring member and a second ring member. The first ring members are movable relative to the housing and the second ring members between a closed position and an open position. In the closed position the first and second ring members form a substantially continuous, closed loop for allowing loose-leaf pages retained by the rings to be moved along the rings from one ring member to the other. In the open position the first and second ring members form a discontinuous, open loop for adding or removing loose-leaf pages from the rings. The mechanism has first and second hinge plates supported by the housing for pivoting motion relative to the housing. The first ring members are mounted on the first hinge plate and moveable with the pivoting motion of the first hinge plate between the closed and open positions. An actuator is pivotable relative to the housing about a pivot axis to cause the pivoting motion of the hinge plates. The actuator is pivotable between a first position in which the ring members are in the closed position and a second position in which the ring members are in the open position. The actuator has: (i) a body; (ii) a closing arm extending from the body and positioned to pivot the hinge plates and move the rings to the closed position when the actuator moves from the second position to the first position; (iii) an opening arm extending from the body and positioned to pivot the hinge plates and move the rings to the open position when the actuator moves from the first position to the second position; (iv) a handle extending from the body for use by a user to pivot the actuator between the first and second positions; and (v) a generally channel shaped space in the actuator. The mechanism includes a travel bar having a locking element. The travel bar is moveable by the pivoting movement of the actuator between a locked position in which the locking element blocks pivoting movement of the hinge plates to move the rings from the closed position to the open position and an unlocked position in which the locking element permits pivoting movement of the hinge plates to open the rings. The travel bar has an end that is captured by the actuator in the space. The travel bar and actuator are adapted so the end of the travel bar can be snapped into said space during assembly of the ring mechanism by moving the travel bar relative to the actuator in a direction that is generally perpendicular to the pivot axis of the actuator.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
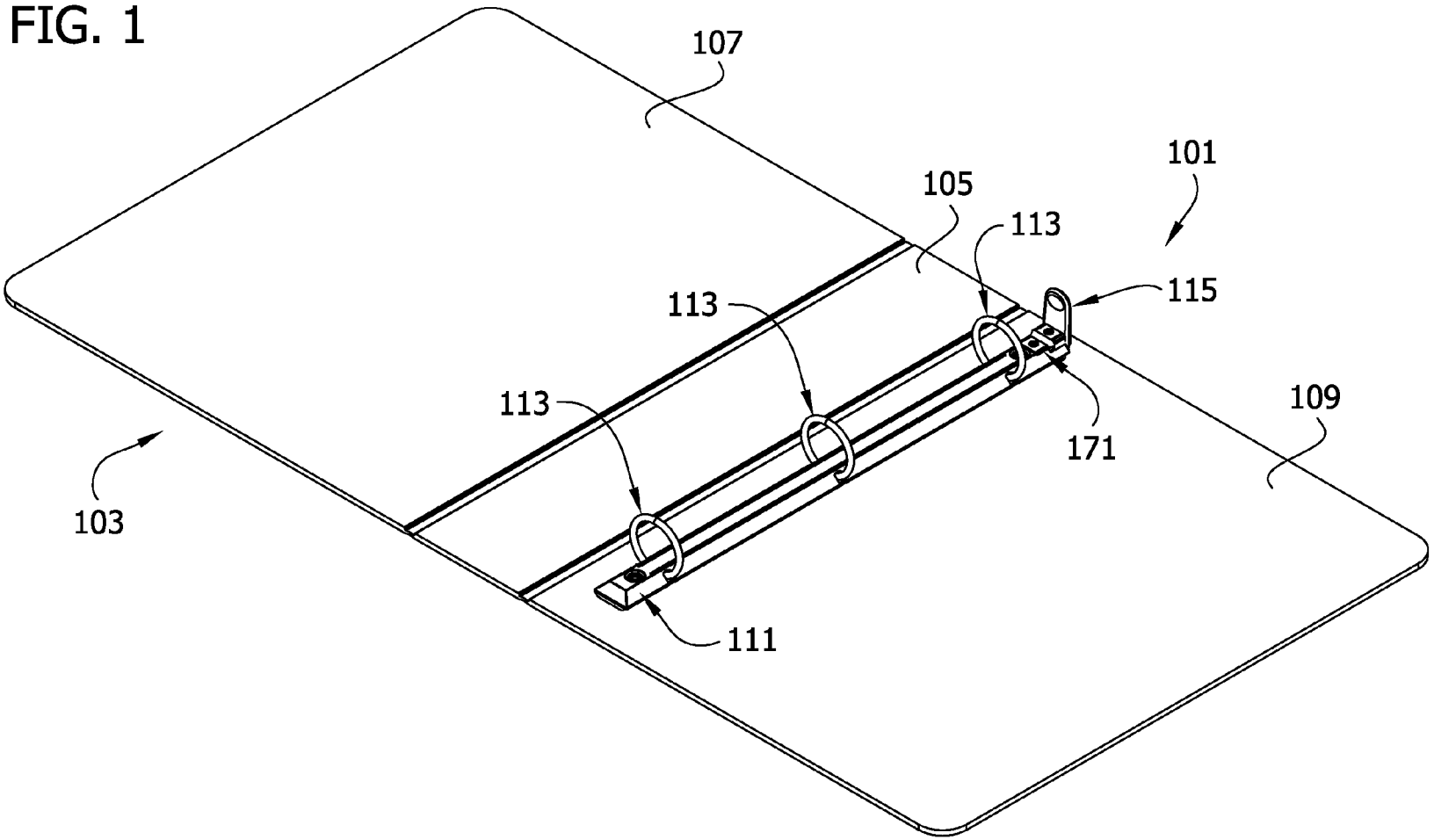
FIG. 1 is a perspective of a notebook and a ring binder mechanism.
Figure 2:
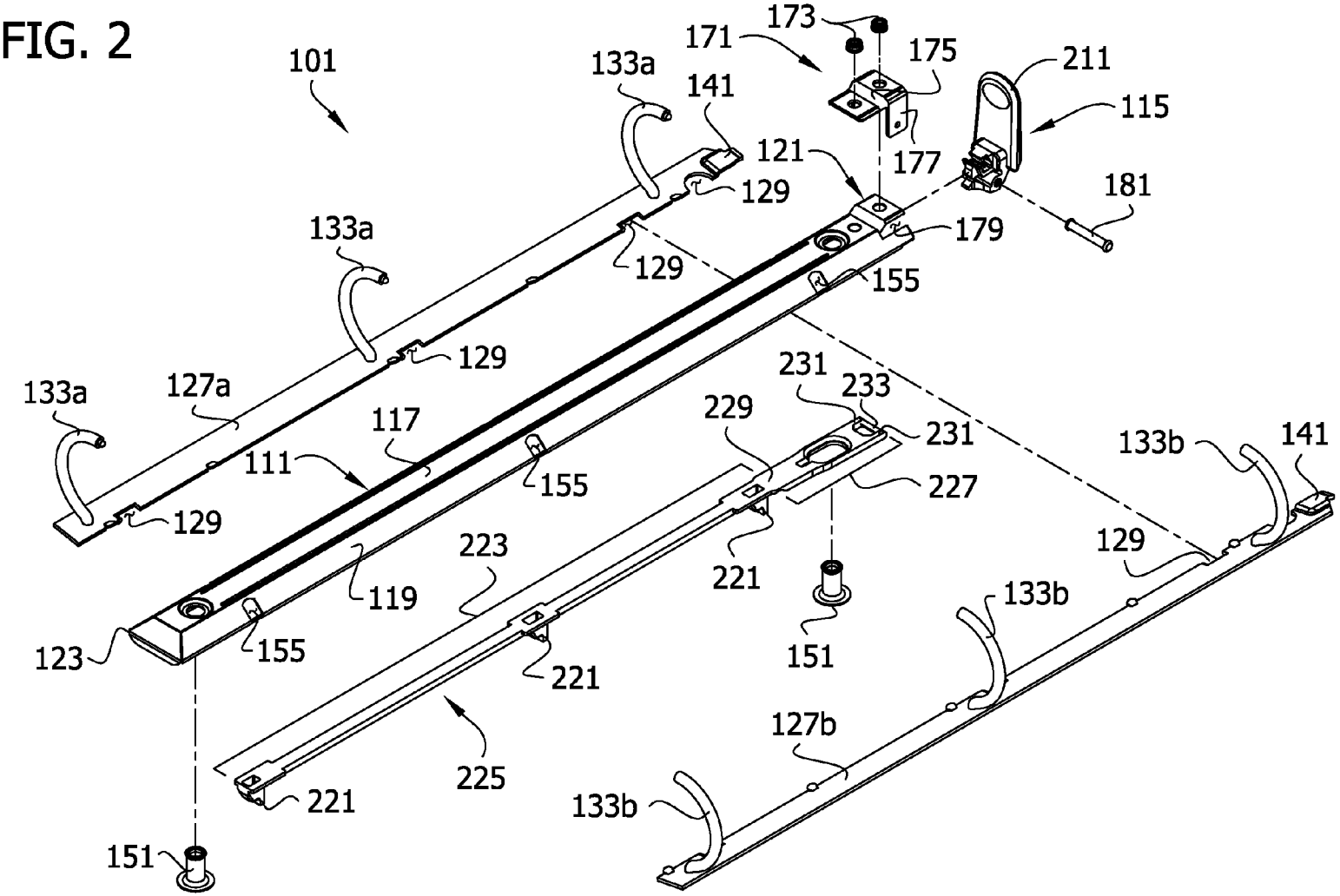
FIG. 2 is an exploded perspective of the ring mechanism.

Referring to the drawings, FIGS. 1-2 show a first embodiment of a ring binder mechanism of the invention, generally indicated at 101. In FIG. 1, the mechanism 101 is mounted on a notebook cover 103. Specifically, the mechanism 101 is mounted adjacent the spine 105 of the notebook cover 103. The spine 105 extends between front and back covers 107, 109 that are hingedly attached to the spine 105. The front and back covers 107, 109 are moveable to selectively cover or expose loose-leaf pages (not shown) retained by the mechanism 101. Ring binder mechanisms mounted on a notebook cover in other ways (e.g., on the spine) or on substrates other than a notebook cover (e.g., a file, a briefcase, etc.) do not depart from the scope of this invention.

As shown in FIGS. 1 and 2, the mechanism 101 includes an elongate housing 111 supporting a plurality of rings (each of which is designated generally 113). The housing 111 has a generally rectangular perimeter. The housing 111 also has a raised flat central plateau 117 and sides 119 extending down and laterally outward from opposite sides of the plateau. The plateau 117 and sides 119 give the housing a roughly arch-shaped cross sectional shape. The flatness of the plateau 117 and sides 119 make the arch-shaped cross sectional shape of the housing 111 illustrated in FIGS. 1 and 2 a segmented and angular arch shape. However, it is understood that the sides and central top portion of the housing can be more smoothly curved within the scope of the invention. A first longitudinal end 121 of the housing 111 is generally open while a second, opposite longitudinal end 123 is generally closed. Bent under rims 125 extend lengthwise along the outer edge margins of the sides 119 of the housing 111. Mechanisms having housings shaped differently than the housing 111 illustrated in the drawings, including irregular shapes, or housings that are integral with a file or notebook do not depart from the scope of this invention.

The rings 113 are operable to retain loose-leaf pages on the ring mechanism 101 in the notebook 103. The ring mechanism 101 illustrated in the drawings has three rings 113. However, the number of rings can vary within the scope of the invention. The rings 113 shown in the drawings are substantially identical to one another and are each generally circular in shape. As shown in FIGS. 1 and 2, the rings 113 each include two generally semi-circular ring members 133 (sometimes referred to and designated 133*a* and 133*b* to refer to a particular one of the ring members in a pair) formed from a conventional, cylindrical rod of a suitable material (e.g., steel). Ring binder mechanisms with ring members formed of different material or having different cross-sectional shapes (e.g., oval cross sectional shapes) do not depart from the scope of this invention. Also, the rings do not have to be substantially circular. Further, one of the ring members can have a different shape from the other, such as is the case with D-shaped rings and other asymmetric rings known in the art.

One of the ring members 133*a* of each ring 113 is moveable relative to the housing 111 and the opposing ring member 133*b* between a closed position and an open position. In the ring mechanism 101 shown in the drawings, the two ring members 133*a*, 133*b* each move in a substantially similar way relative to housing 111 to open and close the rings 113, but this is not necessary to practice the invention. For example, one of the ring members of each ring could be fixed to the housing within the scope of the invention. In the closed position (FIG. 1) the ring members 133 form a substantially continuous, closed loop for allowing loose-leaf pages retained by the rings 113 to be moved along the rings from one ring member to the other. In the open position (FIG. 7C) the ring members 133 form a discontinuous, open loop for adding or removing loose-leaf pages from the rings.

Figure 7A:
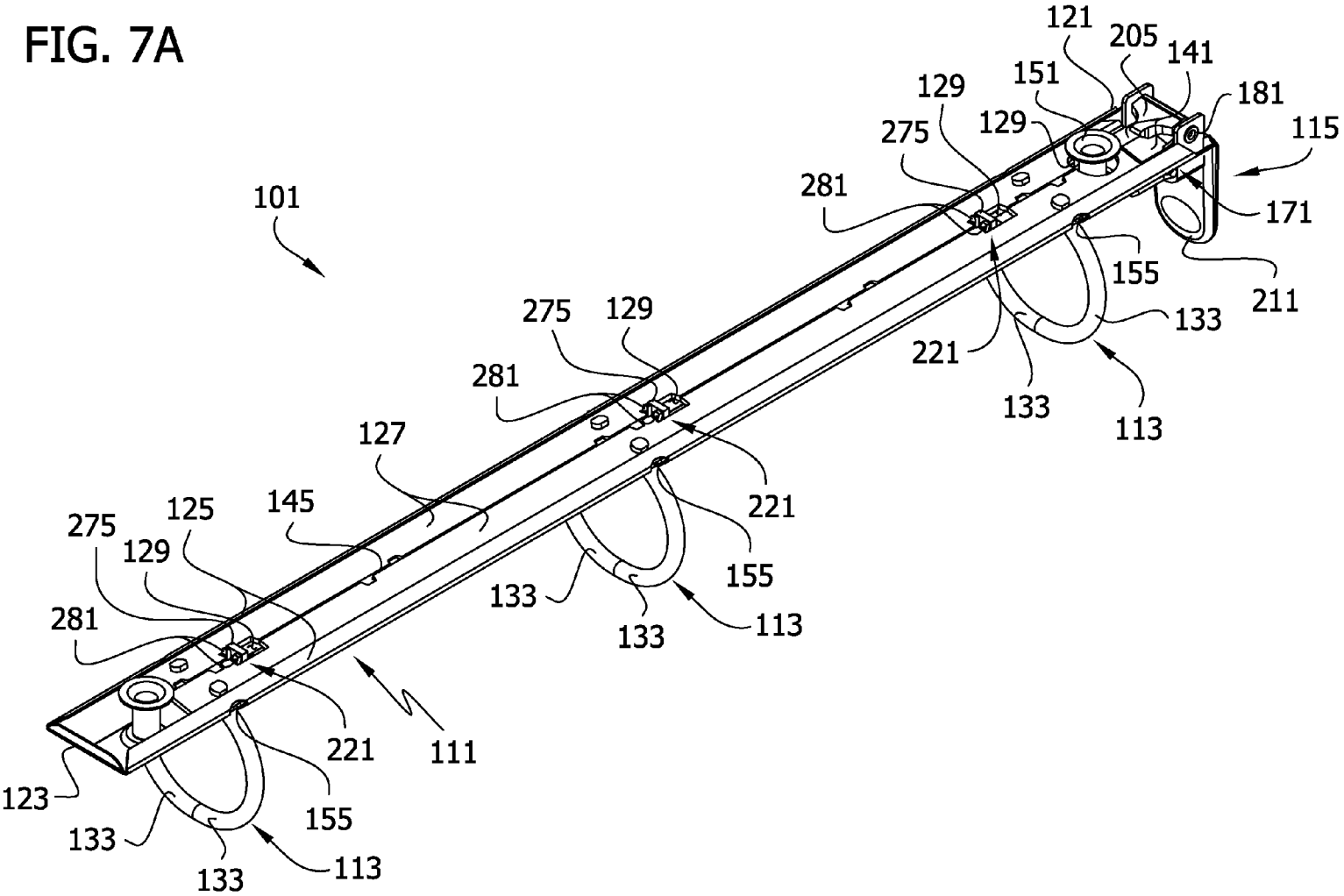
FIGS. 7A-7C are perspectives from a vantage point in which the bottom of the ring mechanism is visible illustrating a sequence in which the actuator is used to open the rings.
Figure 7B:
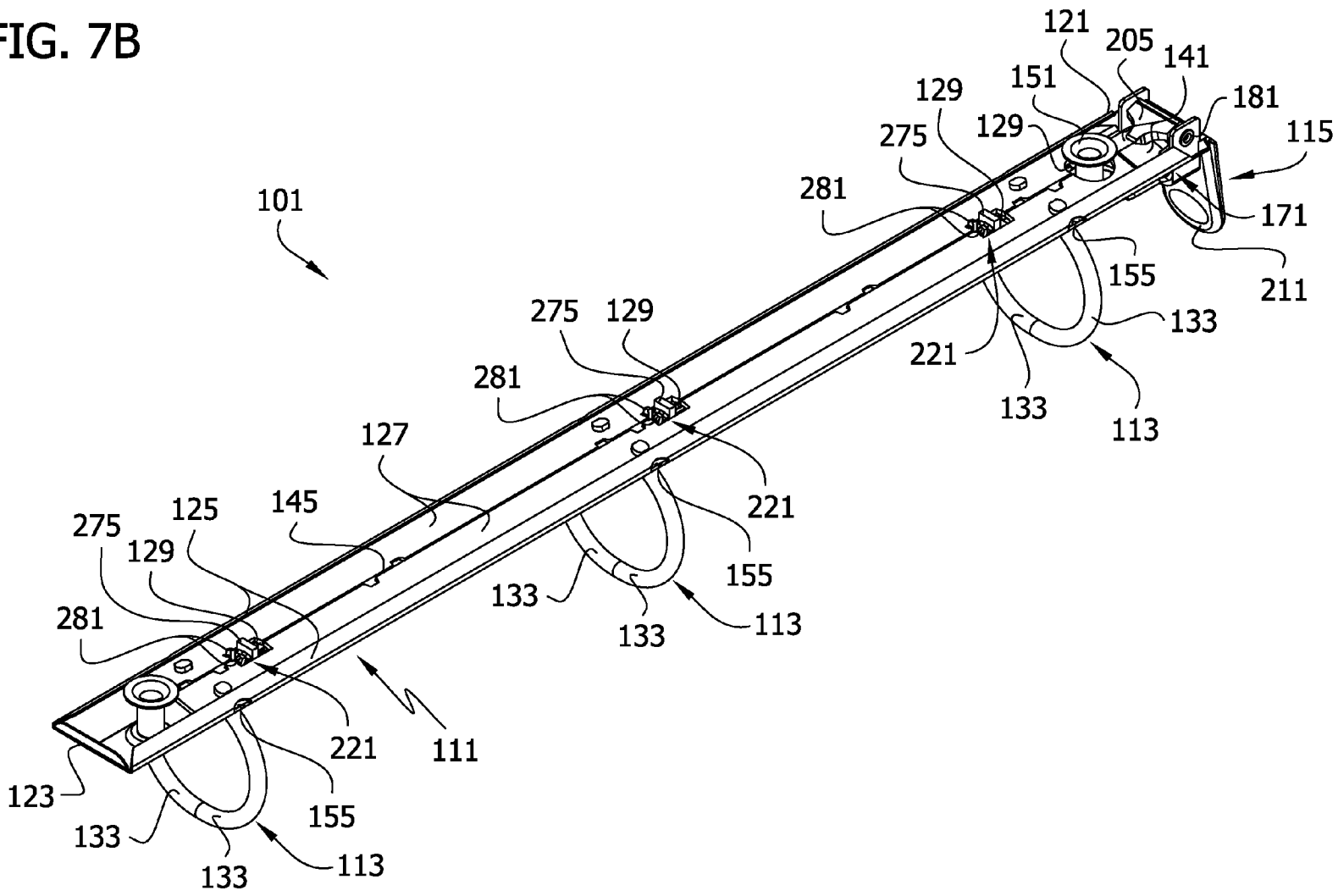
Figure 7C:
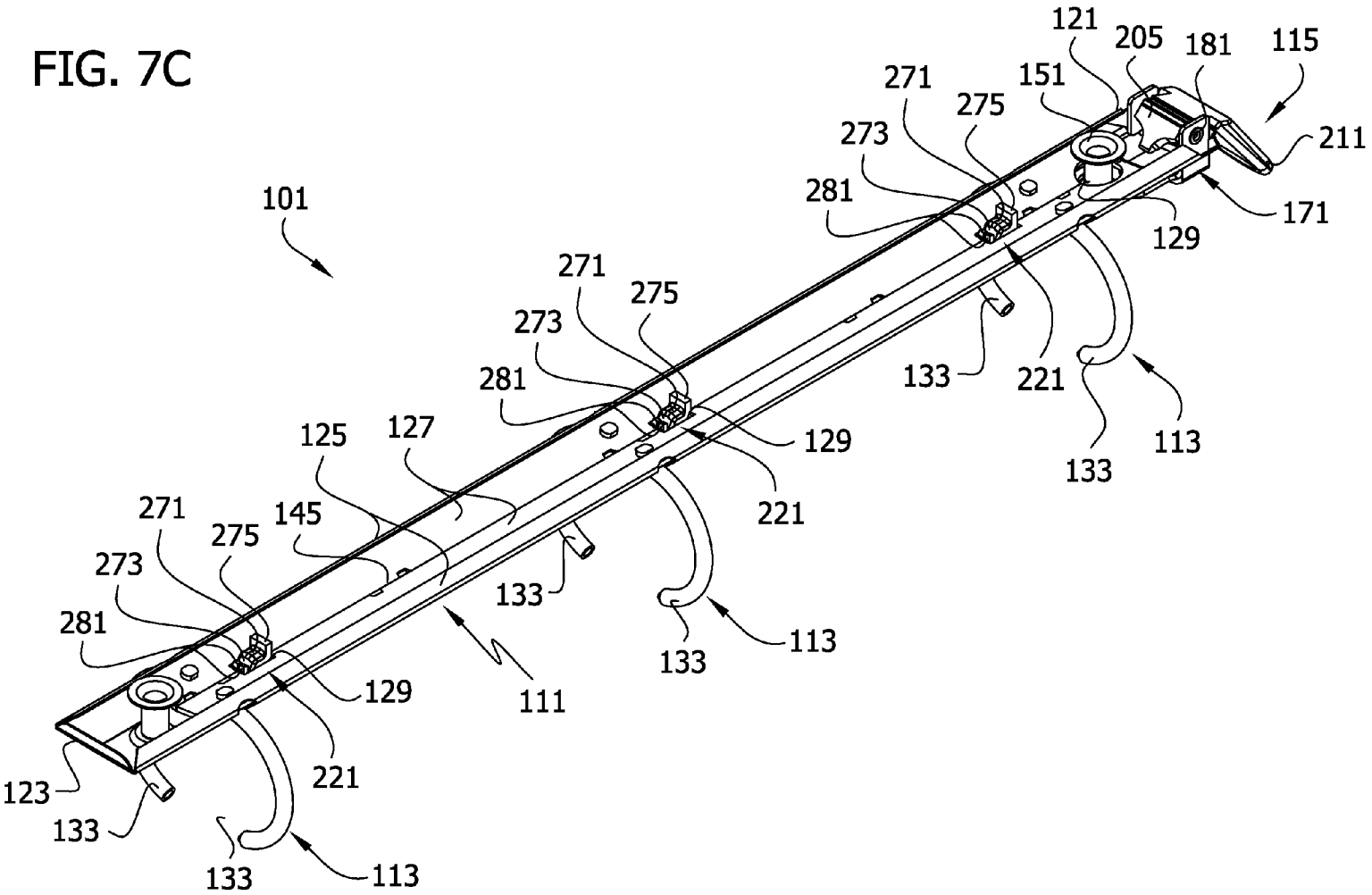

The ring mechanism 101 includes two substantially identical hinge plates 127 supporting the ring members 133. The hinge plates 127 are each generally elongate, flat, and rectangular in shape and are each somewhat shorter in length than the housing 111. The hinge plates 127 are interconnected in parallel arrangement along their inner longitudinal edge margins (as illustrated in FIGS. 7A-7C), forming a central hinge 145 having a pivot axis. This is suitably done in a conventional manner known in the art. The outer longitudinal edge margins of the hinge plates 127 are received in the grooves (FIGS. 3 and 7A-7*c*) formed by the bent under rims 125 of the housing 111, which thereby supports the hinge plates for pivoting within the housing. As shown in FIG. 2, the ring members 133*a*, 133*b* are each mounted in generally opposed fashion on upper surfaces of respective ones of the hinge plates 127 (which are sometimes designated 127*a* and 127*b* to correspond with the designation of the respective ring member). The ring members 133 extend through respective openings 155 along the sides 119 of the housing 111 so that the free ends of the ring members engage one another above the housing when the rings 113 are closed. The ring members 133 are rigidly connected to the hinge plates 127, as is known in the art, and move with the hinge plates when they pivot. In the ring binder mechanism 101 illustrated in the drawings, both ring members 133 of each ring 113 are mounted so they extend from the upper surfaces of the hinge plates 127. However, a mechanism in which one or more ring members are mounted so they extend from a lower surface of the hinge plate (e.g., as disclosed in commonly owned U.S. Pub. Pat. App. No. 20080008519) is also within the scope of the invention.

The hinge plates 127 can be pivoted downward and upward on the central hinge 145 relative to the housing 111 to move the ring members 133 mounted thereon between the closed position and the open position. The ring members 133 close when the hinge plates 127 pivot downward (i.e., the central hinge 145 moves away from the housing 111). The ring members 133 open when the hinge plates 127 pivot upward (i.e., the central hinge axis 145 moves toward the housing 111). The hinge plates 127 are together wider than the spacing between the bent under rims 125 of the housing 111 when in a co-planar position (180 degrees). Consequently, as they pivot through the co-planar position, the hinge plates deform the housing and create a spring force in the housing. The housing spring force biases the hinge plates 127 to pivot away from the co-planar position, either downward or upward. Thus, the housing spring force biases the rings 113 to remain closed when they are in the closed position and biases the rings to remain open when they are in the open position.

An actuator 115 is moveable relative to the housing 111 by a user to cause the pivoting motion of the hinge plates 127 against the spring force from the housing 111 to open and close the rings 113. The actuator 115 is rotatable between a first position (FIG. 6A) in which the ring members 133 are in the closed position and a second position (FIG. 6C) in which the ring members are in the open position.

In the illustrated embodiment, the actuator 115 is mounted for pivoting movement relative to the housing between the open and closed positions on a lever mount 171 (FIGS. 1 and 2) formed separately from the housing 111 and secured to the housing (e.g., by one or more rivets 173 or other suitable fasteners). The lever mount 171 includes a plate 175 positioned on top of the housing plateau 117 at the open end 121 of the housing 111. The lever mount 171 also has arms 177 extending from opposite sides of the plate 175 into the housing 111 through slots 179 at the end 121 of the housing. The actuator 115 is pivotally connected to the lever mount by a pivot pin 181 extending through the actuator and retained by the arms of the lever mount. Thus, the actuator 115 is pivotal about a pivot axis coincident with the pin 181. The lever mount 171 does not extend longitudinally beyond the open end 121 of the housing 111. Also, only a relatively minor portion of the actuator 115 extends longitudinally beyond the open end 121 of the housing 111 when the rings are closed. Other ways of mounting the actuator, including directly to the housing without a separate lever mount do not depart from the scope of the invention.

Figure 3:
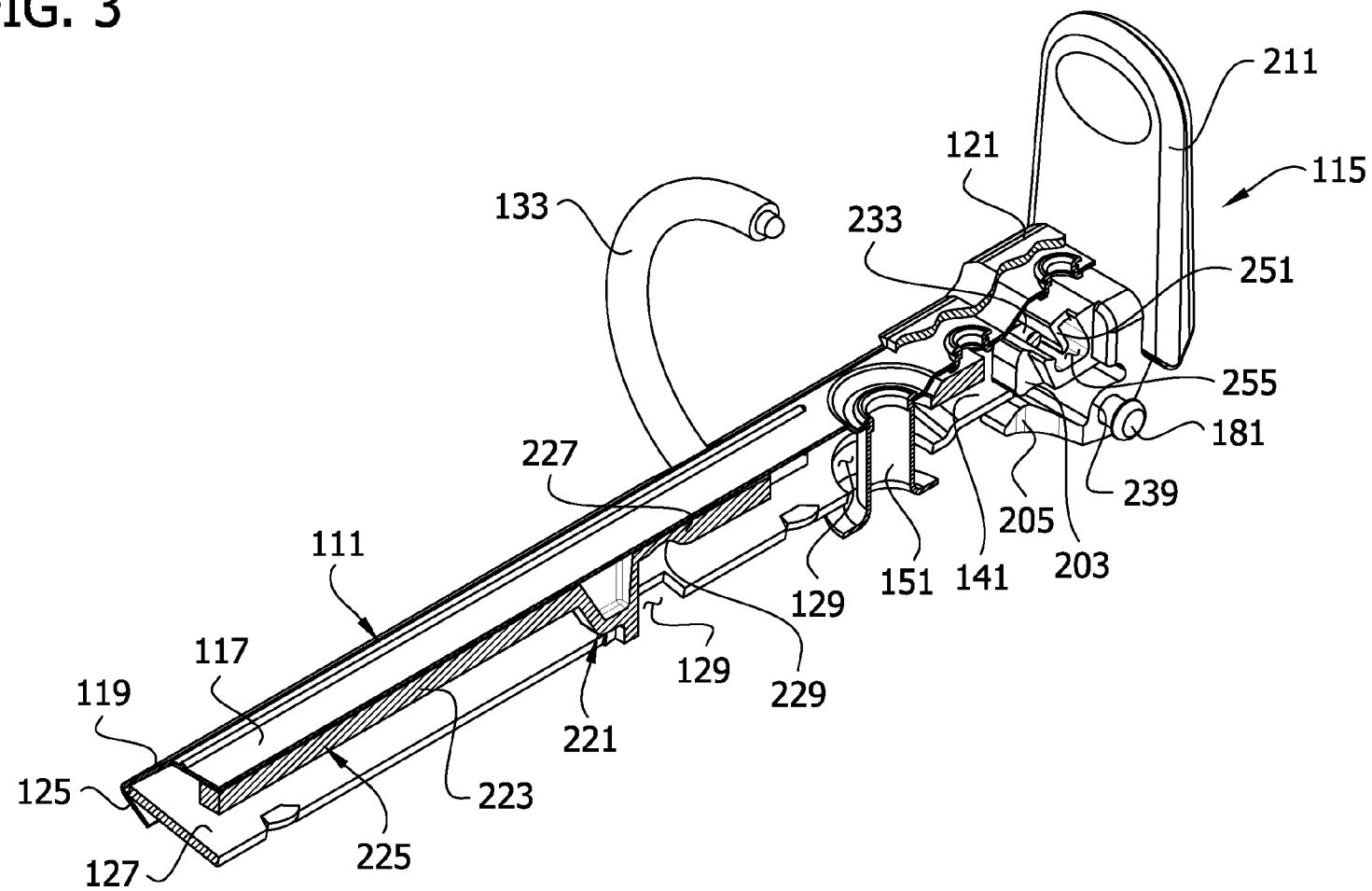
FIG. 3 is an enlarged fragmentary perspective the mechanism in which a portion of the housing is broken away and some features as illustrated in cross section to show internal features of the mechanism.
Figure 4:
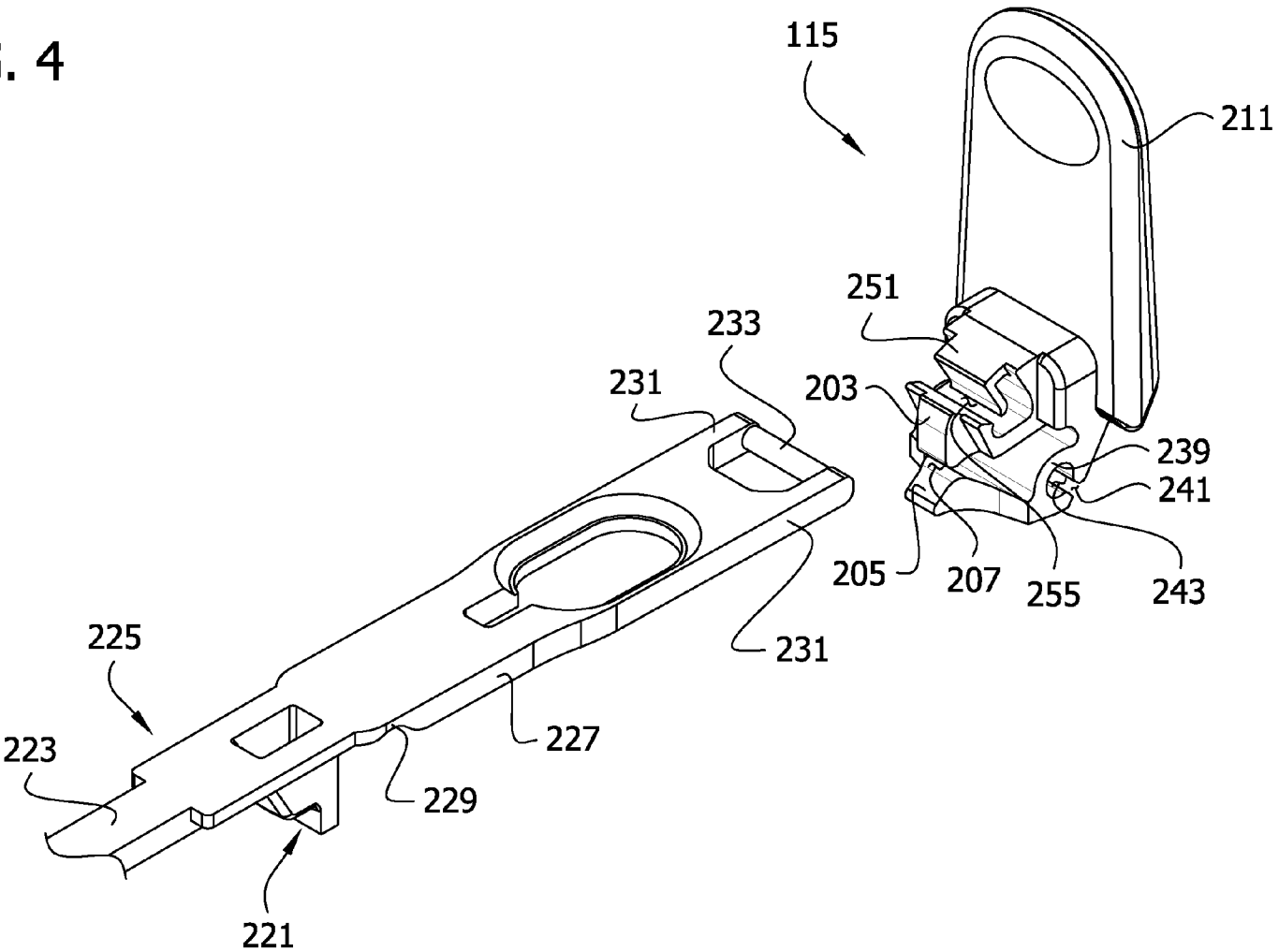
FIG. 4 is an enlarged perspective of an actuator and an end of a travel bar of the ring mechanism prior to their assembly.

Referring now to FIGS. 3, 4, and 6A-6E, the actuator 115 has a body 201 and a closing arm 203 extending from the body. The closing arm 203 is positioned to pivot the hinge plates 127 and move the rings 113 to the closed position when the actuator is moved from the open position to the closed position. The actuator 115 also has an opening arm 205 extending from the body 201 and positioned to pivot the hinge plates 127 and move the rings 113 to the open position when the actuator is moved from the closed position to the open position. As seen in FIGS. 3 and 4, the closing and opening arms 203, 205 form a channel 207 in which the ends of the hinge plates 127 are received. A handle 211 extends from the body 201 of the actuator 115 to facilitate movement of the actuator by a user between the open and closed position. The handle of the actuator can have many different shapes within the scope of the invention.

The ends of the hinge plates 127 are received in the channel 207 so the closing arm 203 is above the ends of the hinge plates and the opening arm 205 is below the ends of the hinge plates. Each of the hinge plates has a relatively narrow finger 141 (FIG. 2) extending longitudinally toward the open end 121 of the housing. The fingers 141 are each narrower in width than the respective hinge plates 127 and are positioned so their inner longitudinal edges are generally aligned with the inner longitudinal edges and central hinge 145 of the hinge plates. When the actuator 115 is moved from the closed position to the open position, the opening arm 205 applies an upward force to the fingers 141 of the hinge plates, which pivots the central hinge 145 upward to open the rings 113.

Likewise, when the actuator is moved from the open position to the closed position, the closing arm 203 applies a downward force to the fingers 141, which pivots the central hinge 145 downward to close the rings 113.

In addition to opening and closing the rings 113 as described above, the actuator 115 is also adapted to move a locking element 221 between a locking position (FIG. 6A) a non-locking position (FIG. 6B) as the actuator is moved between its open and closed positions to open and close the rings 113. In the locking position, the locking element 221 prevents movement of the rings 113 from the closed position to the open position by blocking the pivoting motion of the hinge plates 127. In the non-locking position, the locking element 221 does not block movement of the hinge plates 127 and rings 113 from the closed position to the open position.

As illustrated in FIGS. 2 and 7A-7C, the locking element 221 is one of three identical locking elements (each of which is designated 221) on a locking portion 223 of a travel bar 225, which extends longitudinally in the housing 111 between the hinge plates 127 and the plateau 117 of the housing. The number of locking elements can vary without departing from the scope of the invention. The locking elements 221 are spaced apart longitudinally along the locking portion 223 of the travel bar 225 with one locking element adjacent each longitudinal end of the locking portion 223 of the travel bar, and one located toward a center of the locking portion of the travel bar. The locking elements 221 protrude from the locking portion 223 of the travel bar 225 toward the hinge plates 127. As shown in FIGS. 6A-6E, each locking element 221 includes a flat bottom 271, an angled forward edge 273, and a rearward extension 275. The angled edges 273 of the locking elements 221 may engage the hinge plates 127 and assist in pivoting the central hinge 145 of hinge plates down during closing. In the illustrated embodiment, the locking elements 221 are formed integrally as one piece of material with the travel bar 225 by, for example, a mold process. But the locking elements may be formed separately from the travel bar and attached thereto without departing from the scope of the invention. Additionally, locking elements with different shapes, for example, block shapes (e.g., no angled edges), are within the scope of this invention. The travel bar 225 and locking elements 221 may be broadly referred to as a "locking system."

Cutouts 129 (FIG. 2) are formed in each of the hinge plates 127 along an inner edge margin of the plate. The cutouts 129 in each of the individual hinge plates 127 align to form four openings (also designated 129) along the central hinge 145 of the interconnected hinge plates, as best illustrated in FIGS. 7A-7C. A mounting post 151 passes through one of the openings 129 in the hinge plates 127 proximal to the open end 121 of the housing 111. The three other openings 129 are positioned axially along the central hinge axis 145 of the hinge plates 127 in proximity to the locking elements 221. The locking portion 223 of the travel bar 225 and the locking elements 221 are moveable longitudinally of the housing 111 between the non-locking position (FIG. 6B) in which each of the locking elements 221 is in registration with one of the openings 129 in the hinge plates 127 and a locking position (FIG. 6A) in which each of the locking elements is out of registration with the respective opening in the hinge plates.

A connector portion 227 of the travel bar 225 connects the locking portion 223 of the travel bar to the actuator 115. The connector portion 227 of the travel bar 225 is suitably attached to the locking portion 223 by a hinge 229 (e.g., a living hinge) that allows pivoting movement of the connector portion relative to the locking portion to facilitate conversion of the motion of the connector portion, which can be driven by the actuator 115 in a manner than includes some rotation, to linear movement of the locking portion of the travel bar. The hinge 229 suitably has greater flexibility than the connector portion 227 of the travel bar 225, for example due to construction of the hinge as a segment of the travel bar that has a reduced thickness compared to the connector portion 227. It is not necessary to include any significant compressibility of the hinge 229. As illustrated, the entire travel bar 225 (including the locking elements 221, locking portion 223, hinge 229, and connector portion 227) is suitably formed integrally as a single unitary piece of a moldable polymeric material. However, it is understood that various components of the travel bar may be made manufactured separately and assembled to form a non-unitary travel bar within the scope of the invention.

Referring to FIGS. 2 and 3, the end of the connector portion 227 of the travel bar 225 opposite the hinge 229 is at the open end 121 of the housing. The end of the connector portion 227 has arms 231 extending longitudinally of the housing 111 toward the open end 121 and a cross bar 233 at the end of the travel bar 225 and extending between the arms. The cross bar 233 is captured by the actuator 115 so movement of the actuator between the open and closed positions produces movement of the cross bar 233 at the end of the travel bar 225.

It will be appreciated by those skilled in the art that movement of the travel bar 225 and locking elements 221 (i.e., the locking system) should be sequenced relative to movement of the hinge plates 127 so the hinge plates pivot to their closed position before the locking system is moved to the locking position during movement of the actuator to close the rings 113 and also so the locking system is moved away from the locking position before pivoting the hinge plates 127 during opening. Properly sequencing movement of the hinge plates 127 and travel bar in this manner can result in a smooth single action opening movement that unlocks and then opens the rings 113 and also a smooth single action closing movement that closes and then locks the rings 113. As will be described in more detail below, the actuator 115 is adapted to deform to sequence movements of the locking system 221, 225 and hinge plates 127 during opening and closing of the rings 113.

Referring to FIGS. 3, 4, and 6A-6E, the actuator 115 includes a flexible arm 251 formed as one piece with the body 201 and positioned to push the travel bar 225 toward the locking position when the actuator moves from the open position to the closed position. As illustrated, the flexible arm 251 is positioned generally between the closing arm 203 and the handle 211. The closing arm 203 is also positioned generally between the flexible arm 251 and the opening arm 205. The flexible arm 251 is spaced from the closing arm 203.

Figure 5A:
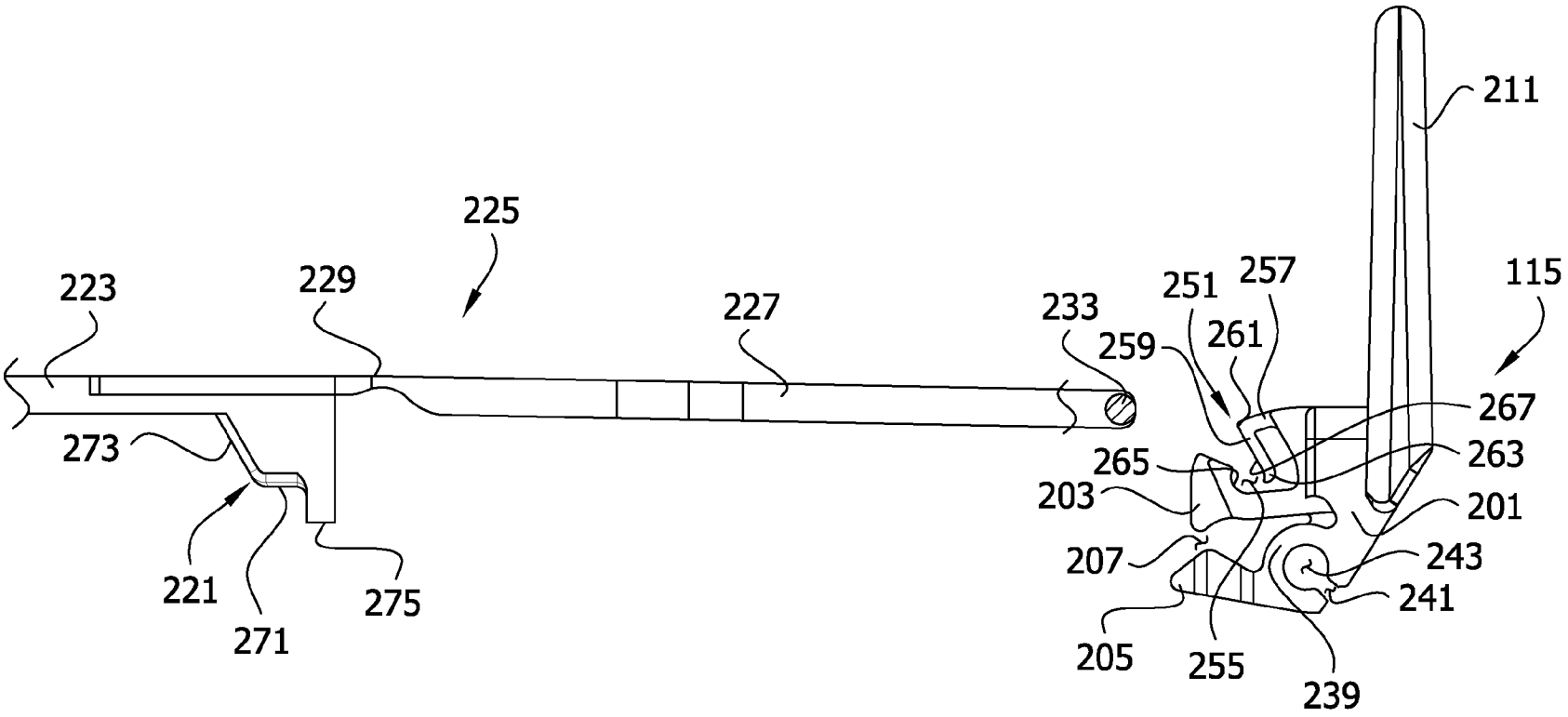
FIGS. 5A-5C are enlarged side views of the actuator and end of the travel bar illustrating an assembly sequence thereof.
Figure 5B:
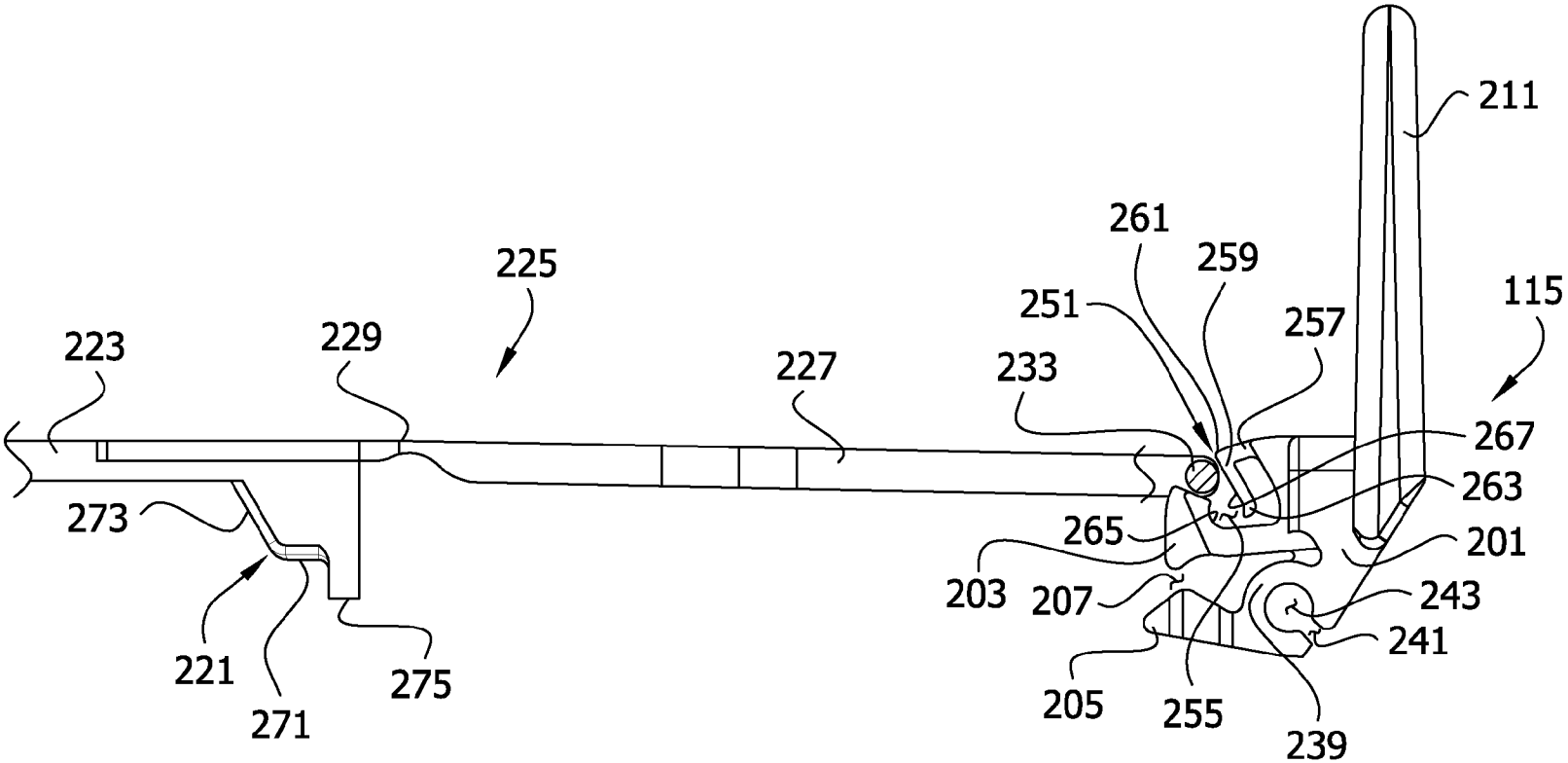
Figure 5C:
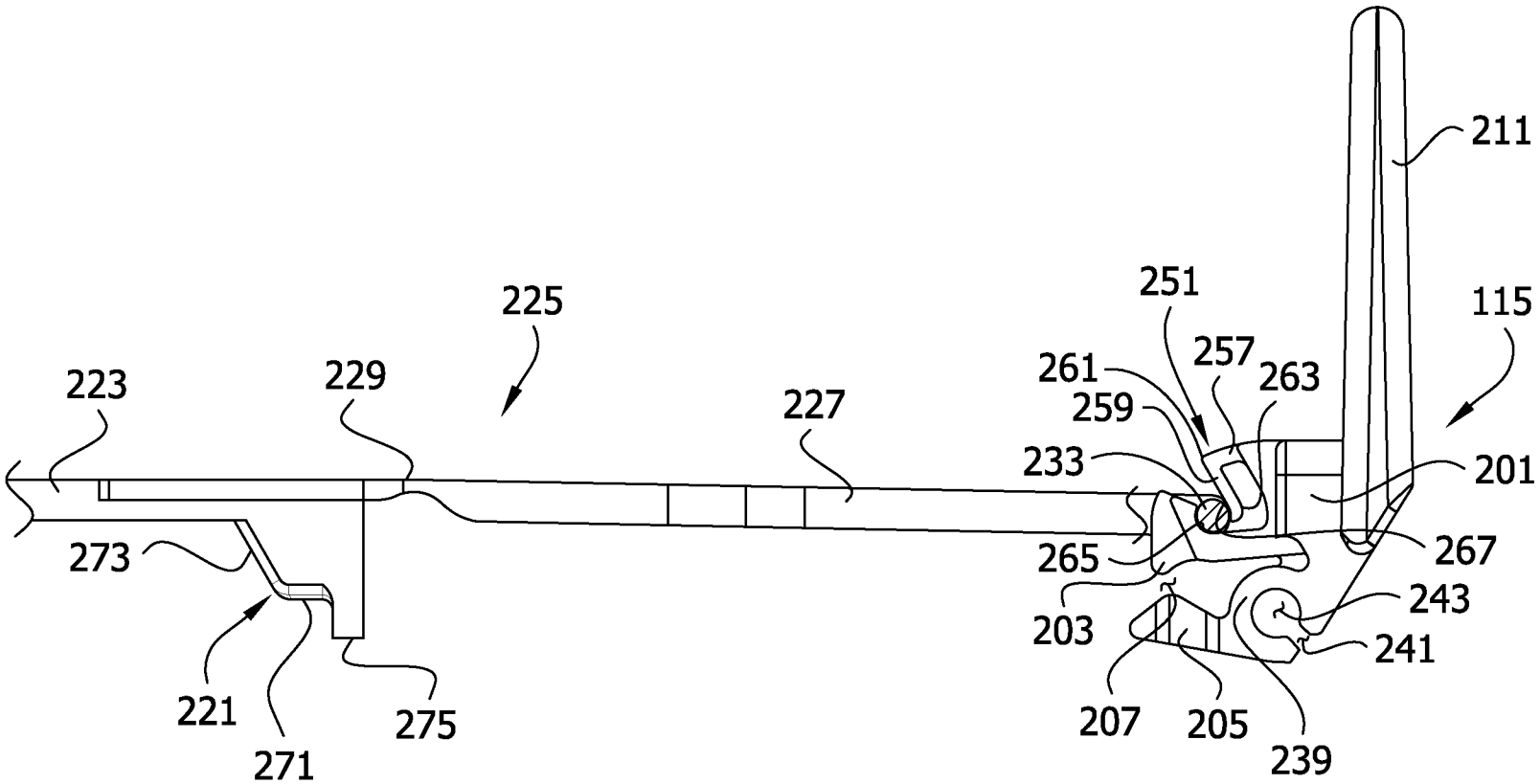

There is a recess 255 (which is part of a larger channel-shaped space defined by the actuator) adjacent the flexible arm 251 in which the cross bar 233 at the end of the travel bar 225 can be captured, as illustrated in FIGS. 5A-5C. In the illustrated embodiment, the recess 255 is between the closing arm 203 and the handle 211 and also generally between the closing arm 203 and the body 201 of the actuator. When the cross bar 233 of the travel bar 225 is captured by the actuator 115, the cross bar extends through the recess 255 from one side of the actuator to the opposite side of the actuator. A portion of the recess is defined by a concaved surface 265 on the rear of the closing arm. The concave surface 265 is shaped to generally conform to the shape of the cross bar 233 to facilitate seating of the cross bar in the concave surface during opening, as will be described in more detail later herein.

The travel bar 225 and actuator 115 are adapted so the cross bar 233 can be snapped into the recess 255 between the closing arm 203 and flexible arm 251 during assembly of the ring mechanism 101 by moving the cross bar relative to the actuator in a direction (e.g., generally downward as illustrated in FIGS. 5A-5*c*) that is generally perpendicular to the longitudinal axis of the cross bar. This can be advantageous because it facilitates use of a travel bar 225 in which the cross bar 233 is formed integrally as one piece with the rest of the connector portion 227. It can also be advantageous because there is no need for precise alignment and insertion of various components into other components, as would be the case if assembly of the travel bar and actuator required a pin or other elongate structure to be inserted longitudinally into an opening that is about the same size as the structure to be inserted therein. This simplifies assembly of the ring mechanism 101.

As illustrated in FIGS. 5A-5C, the cross bar 233 of the travel bar 225 is inserted into the space 255, such that the cross bar 233 is in contact with the flexible arm 251 and also a concave surface 265 on the back of the closing arm 203 (FIG. 5C). The flexible arm 251 may be slightly deformed by the cross bar 233 when it is in the space 255, in which case the preload of the flexible arm results in a force holding the cross bar against the concave back surface 265 of the closing arm 203. However, this is not necessary and the flexible arm 251 can simply abut the cross bar 233 without applying any force thereto after the cross bar 233 has been inserted into the space or there can be a small gap between the cross bar 233 and the flexible arm or concave surface of the closing arm within the scope of the invention.

At least a portion of the flexible arm 251 is adapted to deform when the actuator 115 is moved from the open position to the closed position. Referring to FIGS. 3, 4, and 6A-6E, for example, the flexible arm 251 includes an upper arm portion 257 extending from the actuator body 201 generally away from the open end 121 of the housing 111 and away from the handle 211. The flexible arm 251 also includes a lower arm portion 259 connected to an end 261 of the upper arm portion 257 opposite the body 201. The lower arm portion 259 extends from the end 261 of the upper arm portion 257 radially inward toward the pivot axis (e.g., pivot pin 181) about which the actuator 115 rotates. Thus, the flexible arm 251 extends downwardly into the space in the actuator. The end 263 of the lower arm portion 259 is a free end that is only attached to other structures through the lower arm portion.

The lower arm portion 259 is positioned to push the travel bar 225 (and in particular the cross bar 233) toward the locking position when the actuator 115 moves from the open position to the closed position. Because the lower arm portion 259 extends radially inward from the end 261 of the upper arm portion 257 toward the pivot axis 181, the lower arm portion is adapted to be deformed by reaction forces applied by the travel bar 225 to the arm 251 during closing in manner that includes rotation of lower arm portion. In particular, the lower arm portion 259 is adapted be resiliently rotated relative to the housing 111 during closing in the same direction (e.g., counterclockwise when oriented as illustrated in FIGS. 6A-6E) as the actuator 115 rotates during closing. The deformation of the flexible arm 251 allows movement of the travel bar 225 to lag behind movement of the hinge plates 127 during closing so the locking system does not move to the locking position until after the hinge plates have pivoted down on the hinge 145 sufficiently to provide clearance for the locking elements 121 to move out of registration with the respective openings 129.

The lower arm portion 259 is also shaped to help hold the cross bar 233 in the recess 255 during closing. For example, in FIGS. 6A-6E the lower arm portion 259 has an inclined surface 267 facing the cross bar 233 and oriented to push the cross bar down in the recess 255 toward the closing arm 203, which forms a bottom of the recess, when the flexible arm pushes the cross bar away from the open end 121 of the housing 111 during closing. This helps limit the possibility that the cross bar 233 could unintentionally be dislodged from the recess 255 during operation of the ring mechanism 101.

The actuator 115 is also adapted to sequence movement of the hinge plates 127 and locking system during opening. As shown in FIGS. 4 and 6A-6E, the opening arm 205 of the actuator 115 is attached to the body 201 by a resiliently flexible bridge 239 (or "living hinge") formed as one piece with the body and opening arm. The flexible bridge 239 is generally arch-shaped and defines a cylindrical opening 243. The pivot pin 181 extends through the cylindrical opening 243 to pivotally mount the actuator 115 on the housing 111. The flexible bridge 239 is also configured to form an open channel 241 (FIG. 6A) adjacent the pivot pin 181 between the opening arm 205 and body 201. The opening arm 205 extends away from the body 201 at the bridge 239 and channel 241 in general parallel alignment with the closing arm 203. The flexible bridge 239 is adapted to facilitate sequencing movement of the hinge plates 127 and locking system 221, 225 during opening by allowing movement of the opening arm 205 and hinge plates 127 to lag behind movement of the locking system toward the unlocking position.

It is envisioned that the entire actuator 115 (except for an optional cushion, not shown, that may cover some or all of the handle 211) is formed integrally as one piece (e.g., from a resilient moldable polymeric material). However, the actuator 115 may be formed from other materials or other processes within the scope of this invention. For example, an actuator made of components formed separately and assembled to produce an actuator is within the scope of the invention. A ring mechanism having an actuator shaped differently than illustrated and described herein does not depart from the scope of the invention.

Figure 6A:
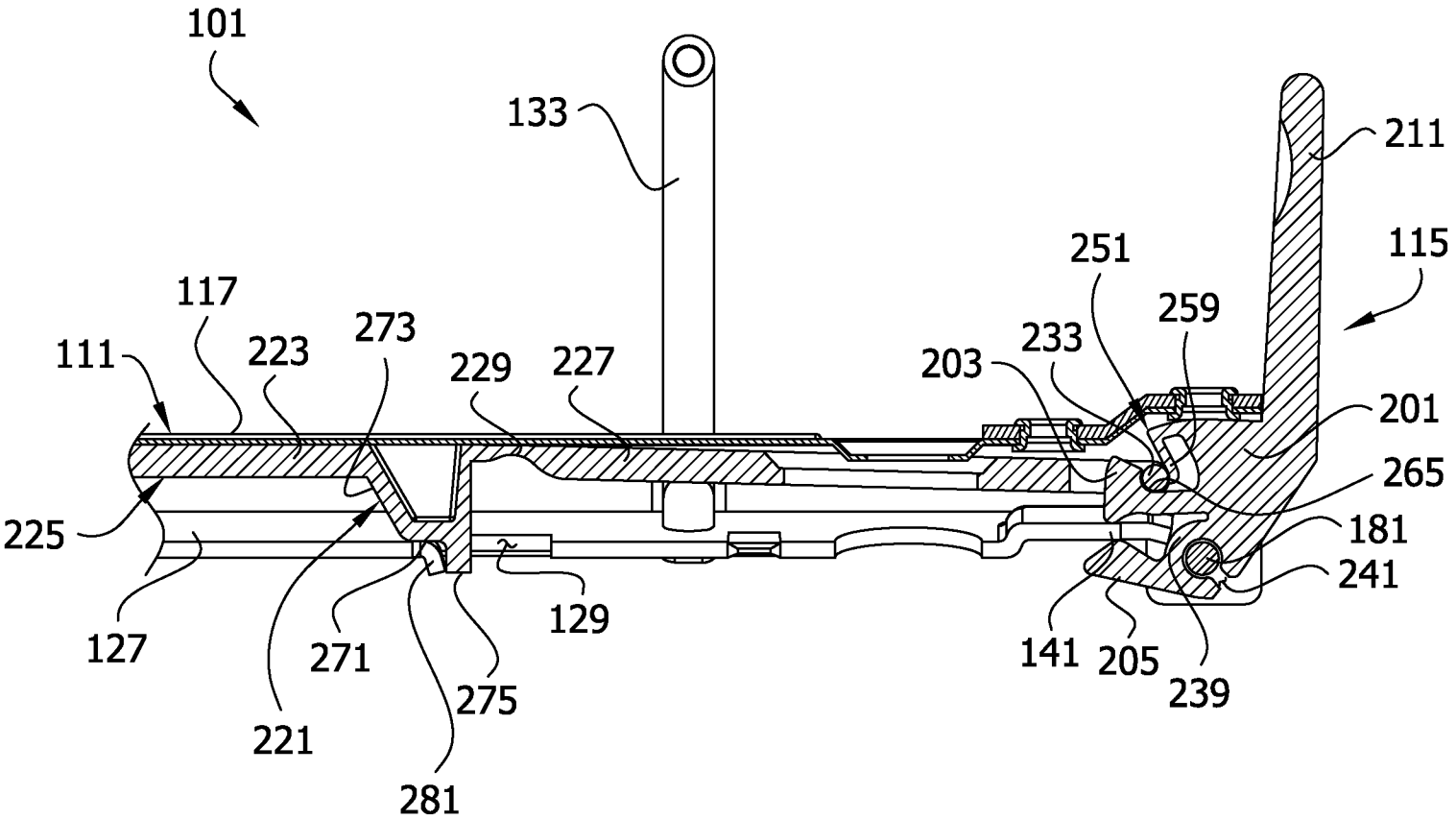
FIGS. 6A-6E are enlarged fragmentary side elevations the ring mechanism in longitudinal cross section illustrating a sequence in which the actuator is used to open and then close the rings.

Operation of the ring mechanism 101 will now be described with reference to FIGS. 6A-6E and 7A-7C. In FIGS. 6A and 7A, the ring mechanism 101 is in a closed and locked position. The hinge plates 127 are hinged downward, away from housing 111, so that the ring members 133 of each ring 113 are together in a continuous, closed loop, capable of retaining loose-leaf pages. The handle 211 of the actuator 115 is substantially vertical relative to the housing 111 (when oriented as illustrated in FIG. 6A) and abuts the open end 121 of the housing. The lower portion 259 of the flexible arm 251 extends into the recess 255 and is spaced from the body 201 of the actuator. The flexible bridge 239 is suitably in a relaxed (i.e., non-deformed) state in which the channel 241 adjacent the hinge pin 181 is open. The locking elements 221 of the travel bar 225 are positioned above the hinge plates 127 and adjacent their respective openings 129, but out of registration with the openings 129. The flat bottom surfaces 271 of the locking elements 221 abut upper surfaces of the hinge plates 127. The rearward extensions 275 of the locking elements 221 extend through each respective opening 129 adjacent forward, downturned tabs 281 of the hinge plates 127. Further, in the closed and locked position of the ring mechanism, closing and opening arms 203, 205 are suitably both in contact with the hinge plates to limit play in the actuator 115.

Figure 6B:
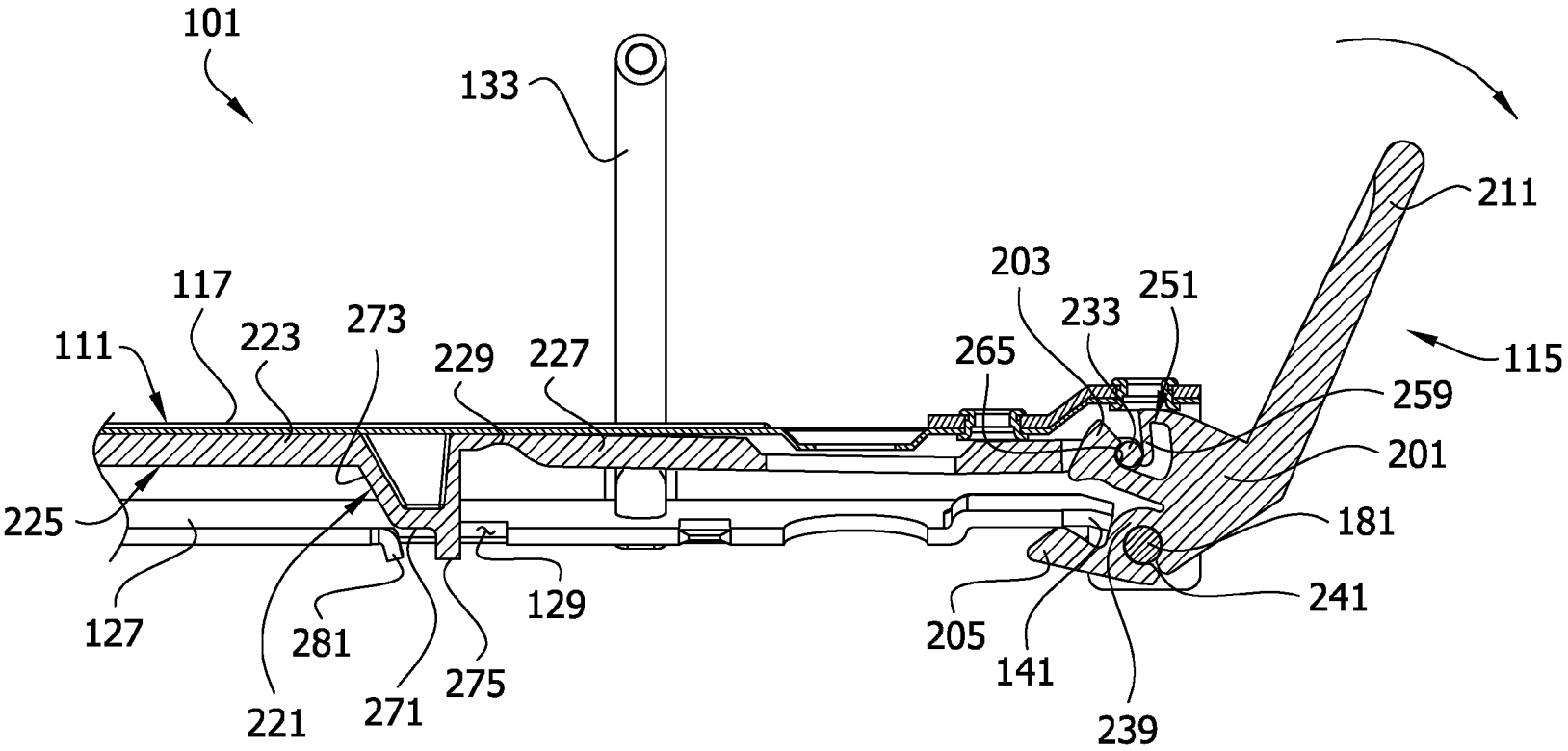

To unlock the ring mechanism 101 and open the rings 113 a user rotates the actuator 115 so the handle 211 rotates away from the plateau 117 of the housing, as illustrated in FIG. 6B. This movement seats the cross bar 233 in the concave surface 265 on the back of the closing arm if it is not already seated therein when the ring mechanism 101 is in the closed position. Thereafter, continued rotation of the actuator 115 causes the closing arm 203 to pull the cross bar 233 and travel bar 225 away from the locking position to the non-locking position (FIG. 6B). Because the cross bar 233 is seated in the concave surface 265 on the back of the closing arm 203, the cross bar is moved along an arcuate path. Accordingly, the connector portion 227 of the travel bar 225 may pivot relative to the locking portion 223 at the hinge 229 during opening.

While the locking system 221, 225 is being moved to the non-locking position by the actuator 115, the upward pivoting movement of the hinge plates 127 at the central hinge 145 is resisted by the engagement of locking elements 221 with the upper surfaces of the hinge plates. Accordingly, upward movement of the opening arm 205 that would result from co-rotation of the opening arm with the body 201 of the actuator 115 is also resisted. The flexible bridge 239 flexes and deforms in response to this resistance in a manner that closes the channel 241 adjacent the pin 181. This deformation allows rotational movement of the opening arm 205 to lag behind the movement of the acutator's body 201 and closing arm 203. Consequently, the upward pivoting movement of the hinge plates 127 required to open the rings 113 is delayed until the closing arm 203 has moved the locking system 221, 225 sufficiently away from the locking position to permit the pivoting motion of the hinge plates.

When the locking system 221, 225 no longer prevents pivoting movement of the hinge plates 127 (as illustrated in FIGS. 6B and 7B), continued rotation of the actuator 115 by the user rotates the opening arm 205 and pushes the central hinge 145 of the hinge plates 127 upwardly until the hinge plates are in the co-planar position (not shown). Once the hinge plates 127 move through the co-planar position, the spring force applied by the housing 111 urges the hinge plates 127 to continue pivoting movement to the open position. As stress on the flexible bridge 239 is relieved during the latter portion of the opening process, elastic restoration forces in the flexible bridge cause it to recoil toward its non-deformed state. Depending on various factors including the strength of the housing spring force, how fast the actuator is rotated by the user, and how quickly elastic restoration forces in the flexible bridge 239 cause the bridge to recoil toward its undeformed state, the opening arm 205 may or may not remain in continuous contact with the hinge plates 127 though completion of the opening sequence.

Figure 6C:
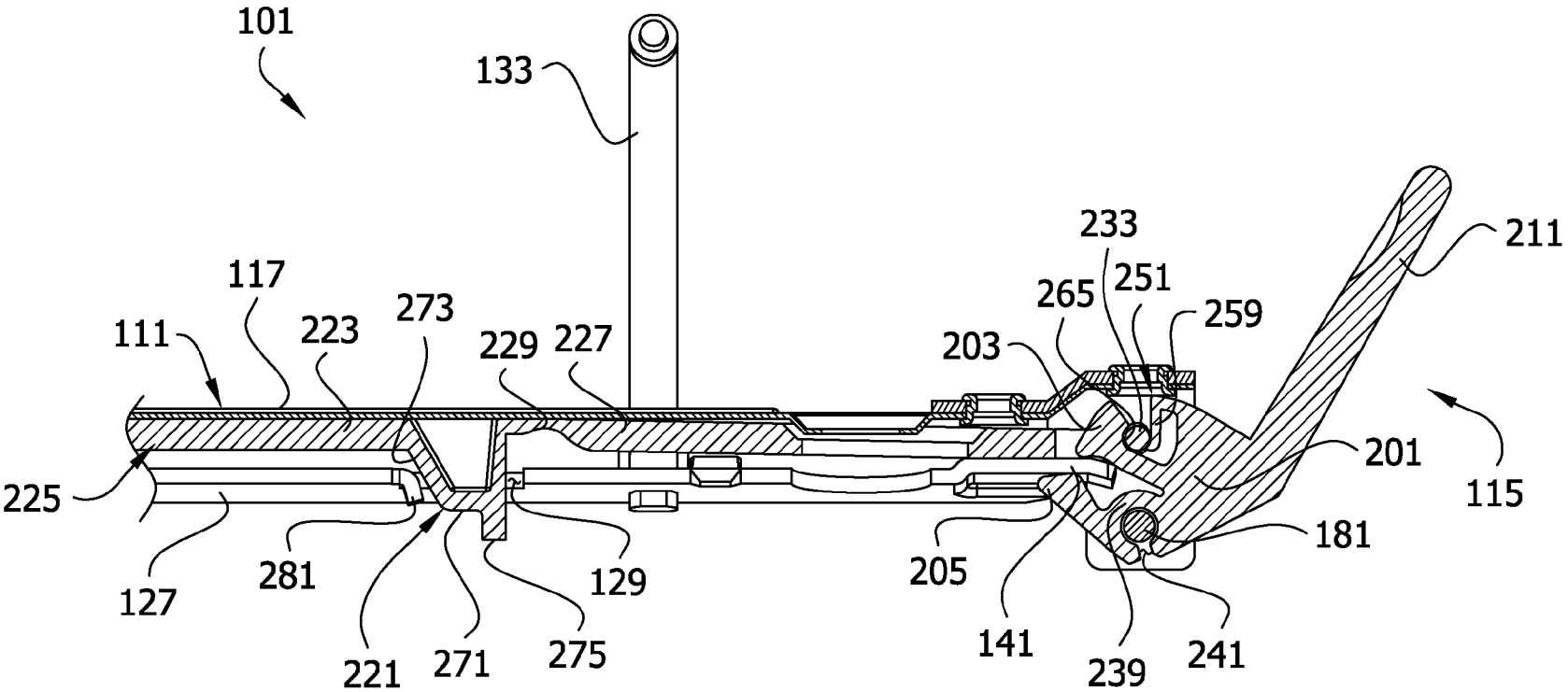

When upward pivoting movement of the hinge plates 127 is complete, the rings 113 are in the open position (as illustrated in FIGS. 6C and 7C). Also, as illustrated in FIG. 6C, the opening and closing arms 205, 203 are suitably both in contact with the hinge plates 127 in the open position to limit play in the actuator 115. The channel 241 adjacent the pivot pin 181 is also at least partially open when the rings are open because of the recoil of the flexible bridge 239 during the latter part of the opening sequence.

To close and lock the ring members 133, a user can simply grip one or more of the ring members directly and move the ring members from the open position to the closed position. This action by the user will cause the central hinge 145 of the hinge plates to pivot downward in the housing 111 and rotate the actuator 115 to the closed position by pushing down on the opening arm 205. If necessary, the flexible bridge 239 may flex and deform to allow movement of the opening arm 205 to precede movement of the actuator body 201 and travel bar 225. After the hinge plates 127 have pivoted out of the way, the actuator body 201 and flexible arm 251 push the travel bar and locking elements 221 to the locking position.

Figure 6D:
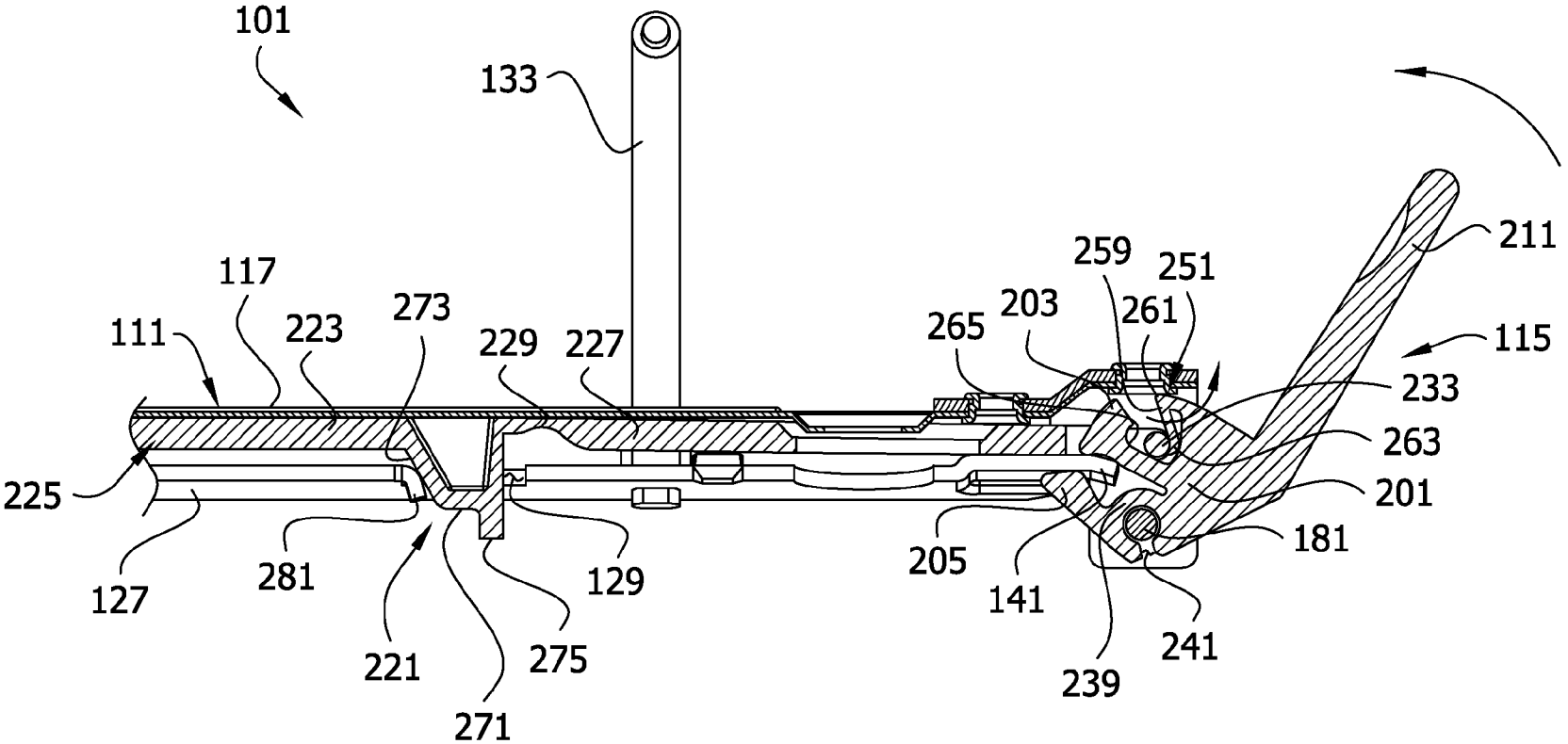
Figure 6E:
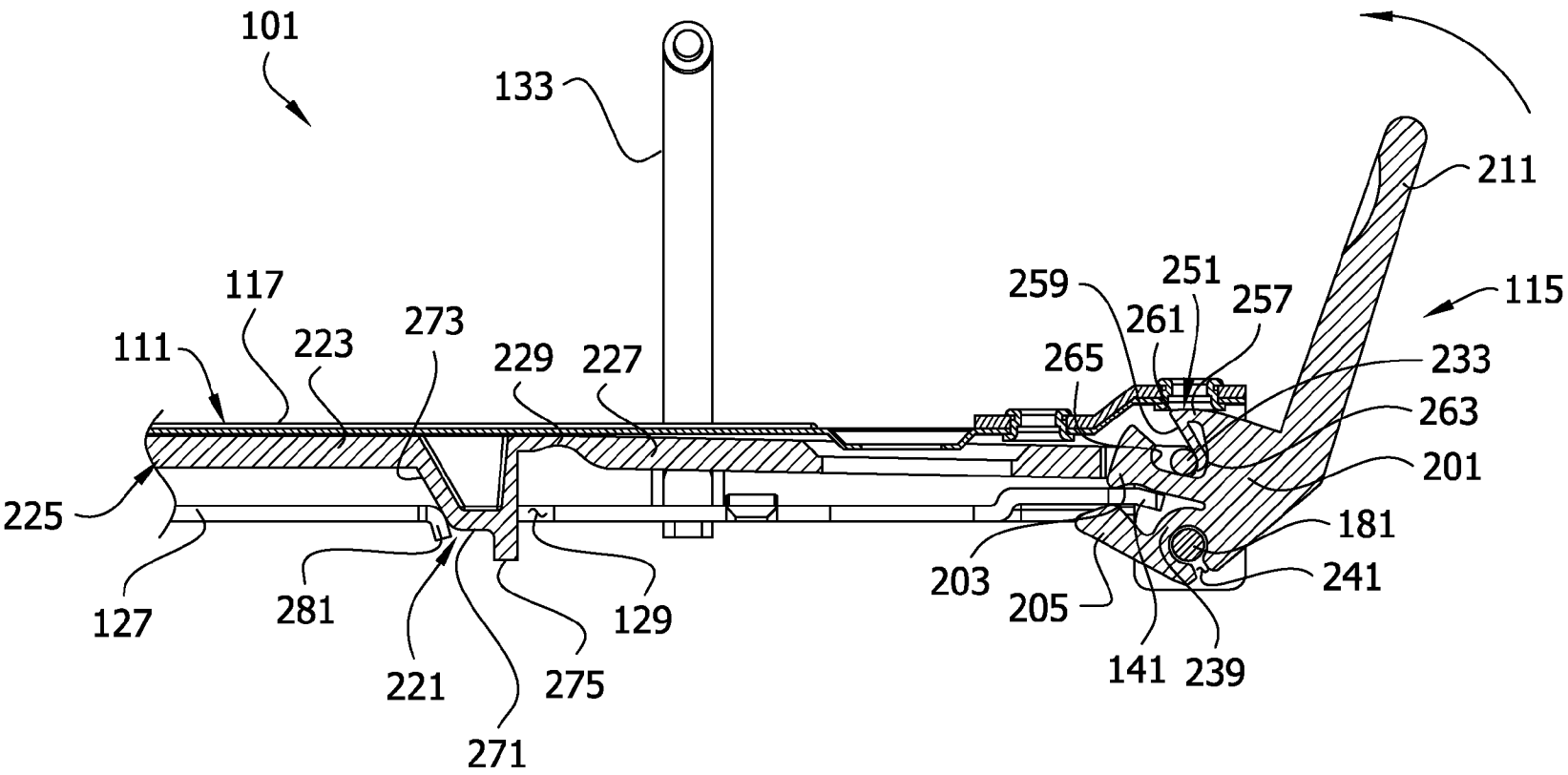

The user also has the option of using the actuator 115 to close and lock the rings 113. To close the rings 113 using the actuator 115, the user rotates the actuator in the reverse direction compared to the opening sequence. For example, the actuator 115 can be rotated (counter-clockwise as illustrated in FIG. 6D) to move the handle 211 toward the plateau 117 of the housing 111. When rotation of the actuator 115 toward its closed position begins, the closing arm 203 pushes down on the central hinge 145 of the hinge plates 127 and initiates pivoting movement of the hinge plates toward the closed position.

The lower portion 259 of the flexible arm 251 contacts the cross bar 233 and begins pushing the travel bar 225 and locking elements 221 thereon toward the locking position. Because of the orientation of inclined surface 267 of the flexible arm 251, the flexible arm also pushes the cross bar 233 down to help hold the cross bar in the recess 255. If the forward edges 273 of the locking elements 221 are not already seated against the hinge plates 127 at the edge of the respective openings 129 when closing movement of the actuator 115 begins, they are so seated by the initial rotation of the actuator.

Once the locking elements 221 are seated against the hinge plates 127 (as illustrated in FIG. 6D), the hinge plates limit further movement of the locking system 221, 225 toward the locking position. The flexible arm 251 deforms during the closing movement of the actuator 115 to allow the cross bar 233 to come unseated from the concave surface 265 on the back of the closing arm 203 and move toward the actuator body 201. In particular, the flexible arm 251 bends at the end 261 of the upper arm portion 257 so the free end 263 of the lower arm portion 259 rotates toward the body 201 of the actuator 115 generally about an axis coinciding with the end 261 of the upper arm portion 257. Thus, the joint between the upper and lower portions 257, 259 of the flexible arm 251 at the end 261 of the upper arm portion flexes like an elbow joint. The rotation of the lower portion 259 of the flexible arm 251 is in the same direction as the rotation of the actuator (e.g., counterclockwise as illustrated) during the closing sequence. The movement of the cross bar 233 relative to the closing arm 203 and actuator body 201 permits movement of the travel bar 225 toward the locking position to lag behind the pivoting movement of the hinge plates 127.

As illustrated in FIG. 6D, after sufficient deformation of the flexible arm 251, the free end 263 contacts the actuator body 201, which limits further movement of the free end of the flexible arm and cross bar 233 relative to the actuator body and closing arm 203. If the hinge plates 127 have not been pivoted sufficiently toward the closed position to allow unimpeded movement of the locking system 221, 225 to the locking position, continued rotation of the actuator 115 causes the actuator body 201 and flexible arm to push the cross bar 233 away from the open end 121 of the housing. The force applied by the actuator 115 to the cross bar 233 is transferred through the travel bar to the locking elements 221 so the angled forward edges 273 thereof push against the tabs 281 to increase the force pivoting the hinge plates toward the closed position.

Once the hinge plates 127 pass through the co-planar position, the housing spring force also urges the hinge plates to continue pivoting movement toward the close position. The actuator body 201 and flexible arm 251 push the locking system 221, 225 to the locking position after the hinge plates 127 have pivoted sufficiently toward the closed position to permit this movement. Once the rings 113 are back in the closed position (FIG. 6A), the flexible arm 251 holds the locking system 221, 225 in the locking position. Thus, the ring binder mechanism 101 effectively retains loose-leaf pages when ring members 133 are closed, and limits the risk of the closed ring members 133 unintentionally opening.

During the closing sequence, the recess 255 is oriented so the bottom of the recess inclines downward as the recess extends toward the open end 121 of the housing, as illustrated in FIG. 6D. The downward force exerted on the cross bar 233 by the flexible arm during closing holds the cross bar against the bottom of the recess. Consequently, as the cross bar 233 at the end of the travel bar 225 moves farther away from the concave surface 265 on the back of the closing arm 203 during closing, the cross bar moves closer to the pivot pin 181 and the pivot axis of the actuator 115 coincident therewith. This reduces the amount of pivoting needed at the hinge 229 to convert movement of the cross bar 233 to linear movement of the locking portion 223 of the travel bar 225. Also, the length of the travel bar 225 remains substantially constant during movement of the actuator to close the rings. For instance, the overall length of the travel bar is suitably shortened by no more than about 1 percent during use of the actuator to close the rings.

Figure 8:
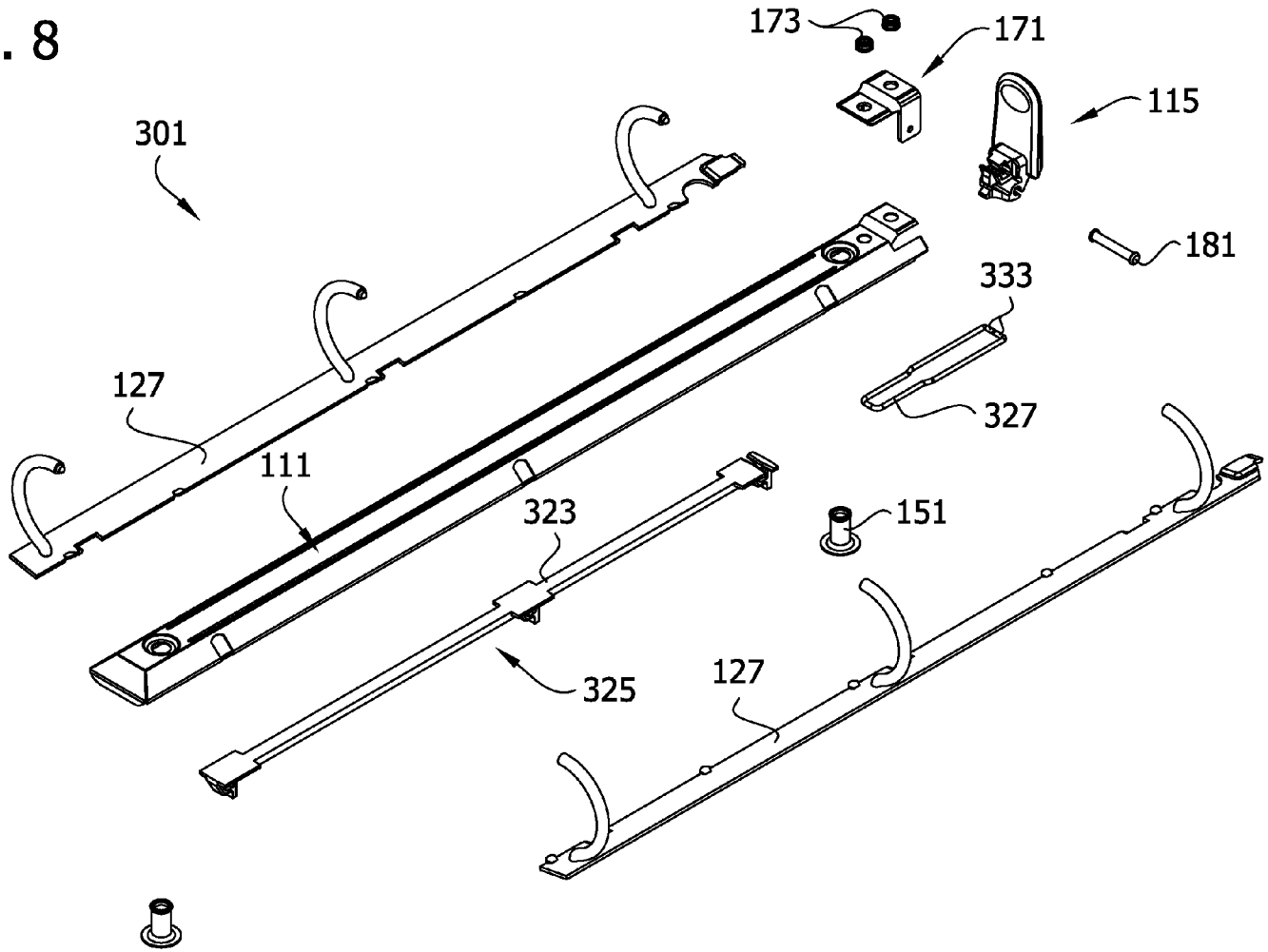
FIG. 8 is an exploded perspective of a second embodiment of a ring mechanism of the present invention.
Figure 9:
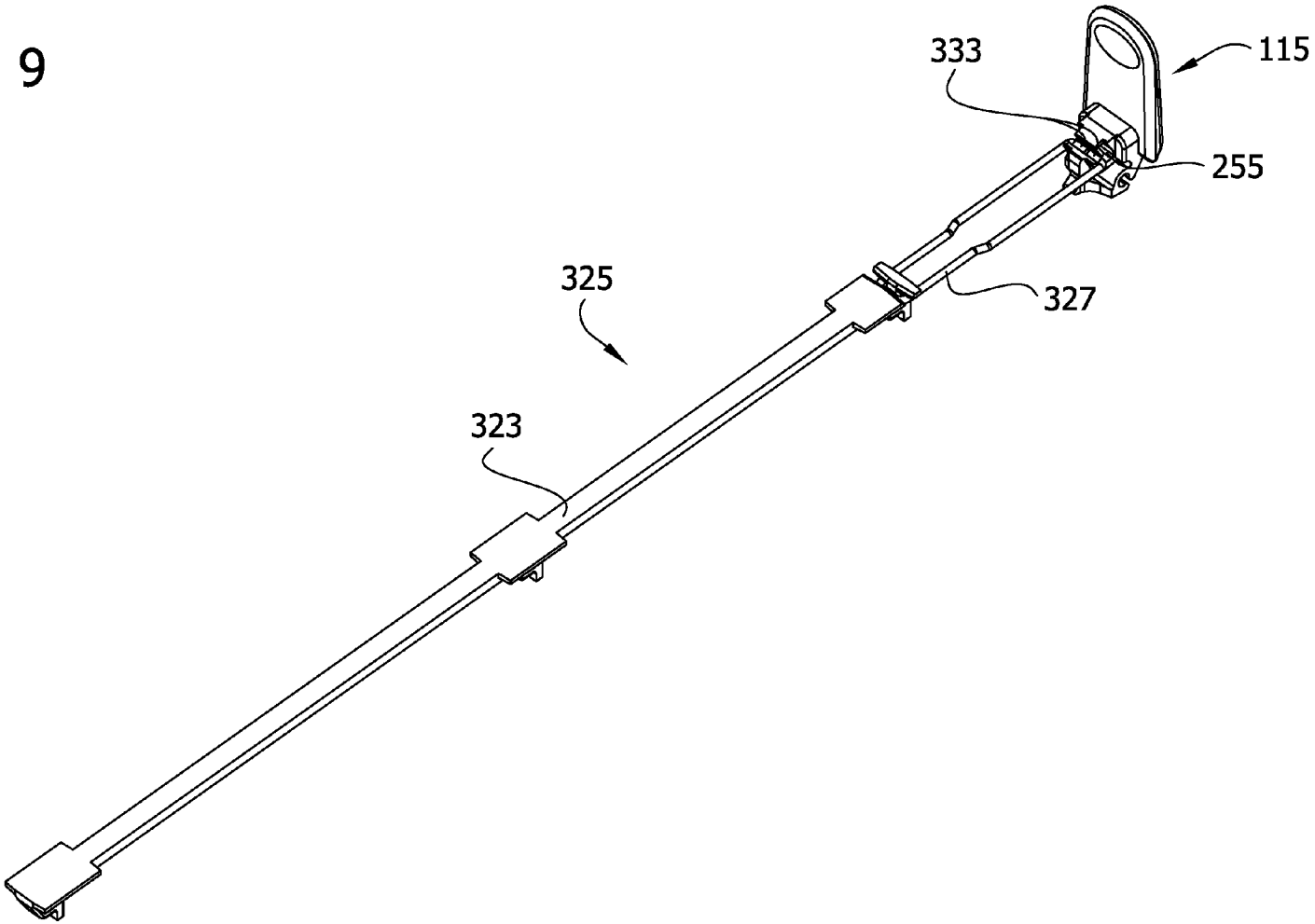
FIG. 9 is a perspective showing a wire connector connecting a travel bar and actuator of the ring mechanism illustrated in FIG. 8.
Figure 10:
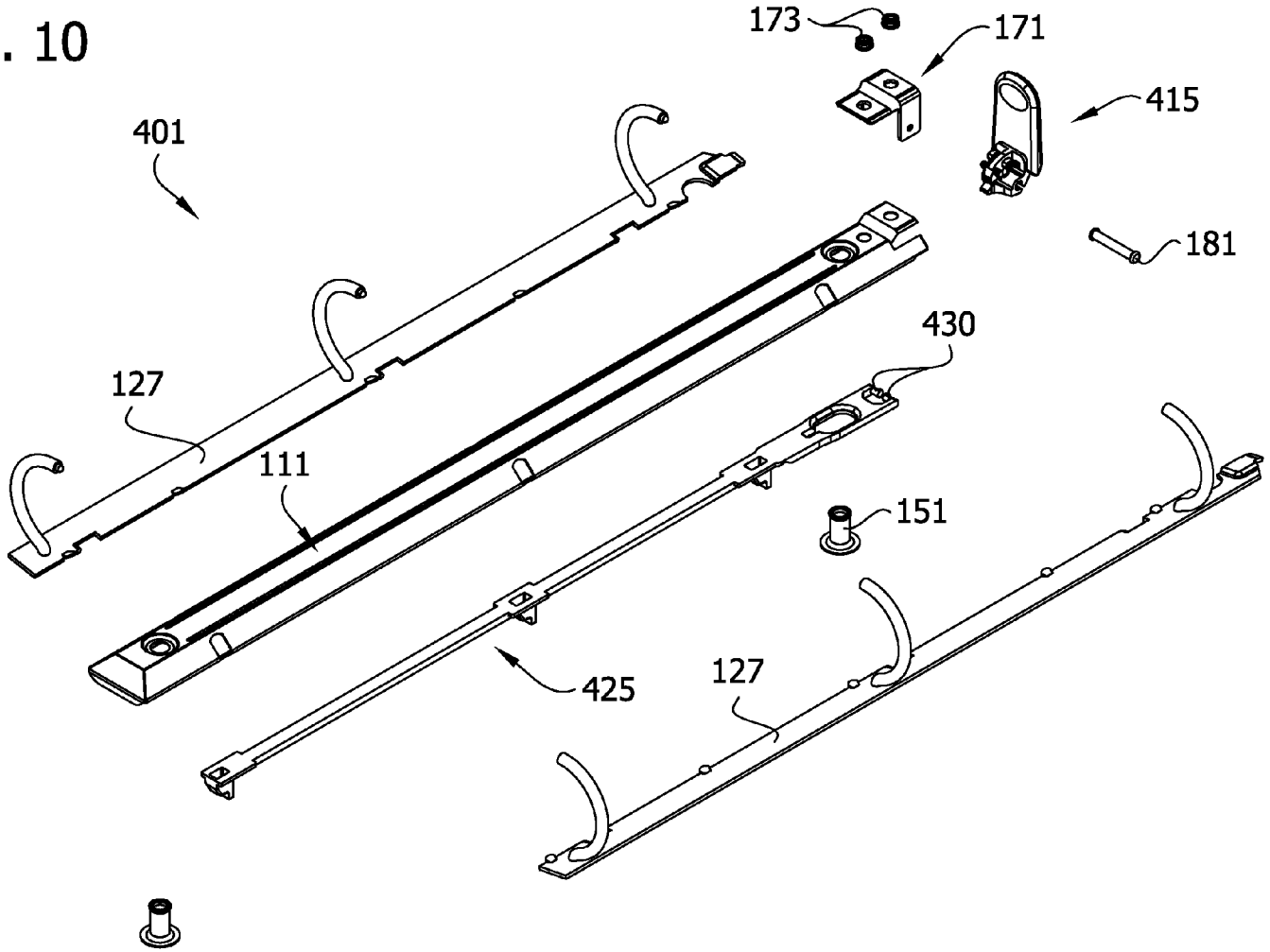
FIG. 10 is an exploded perspective of a third embodiment of a ring mechanism of the present invention.
Figure 11:
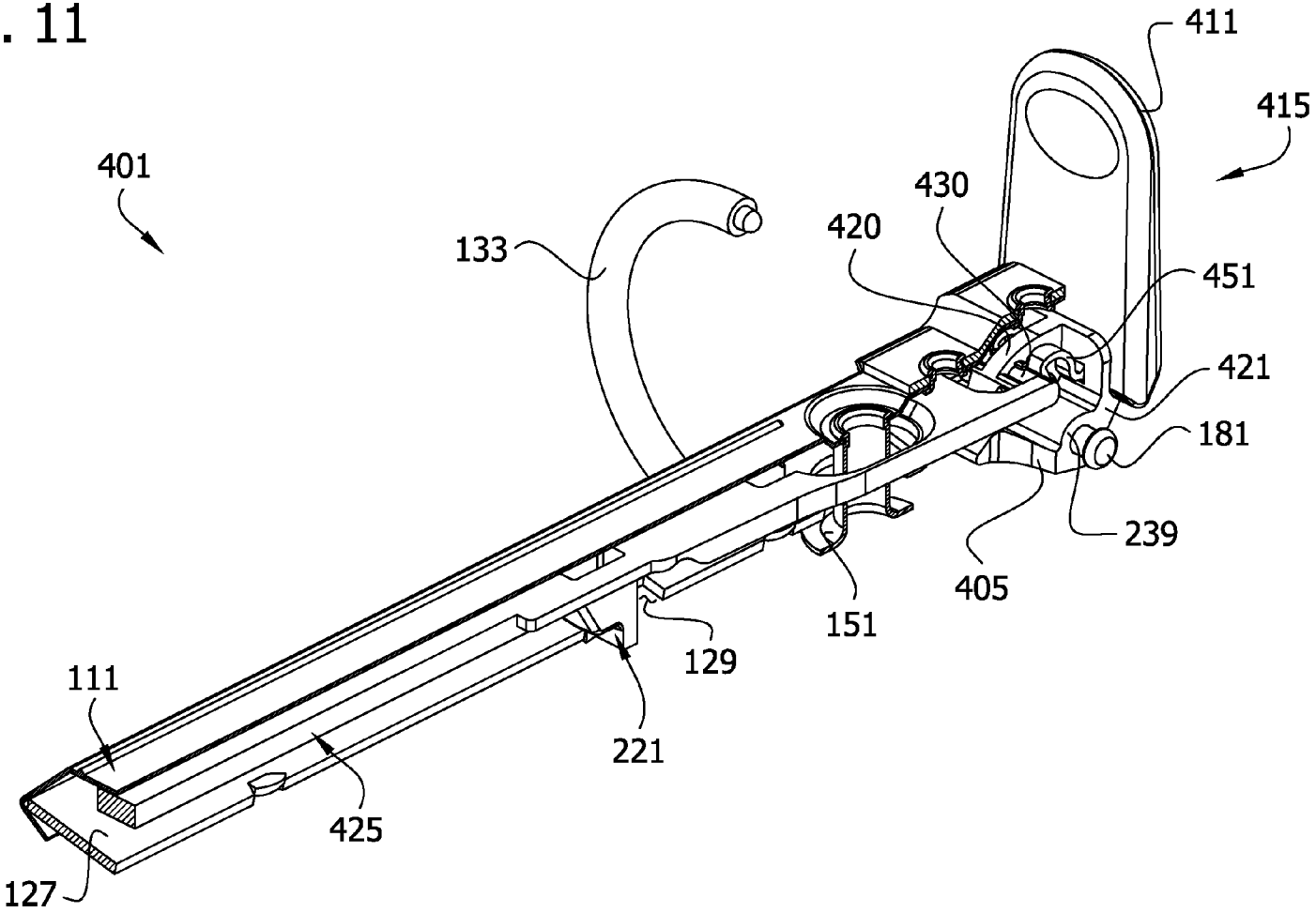
FIG. 11 is an enlarged fragmenatary perspective of the ring mechanism illustrated in FIG. 11 in which some parts are illustrated in longitudinal cross section to show internal features.
Figure 12:
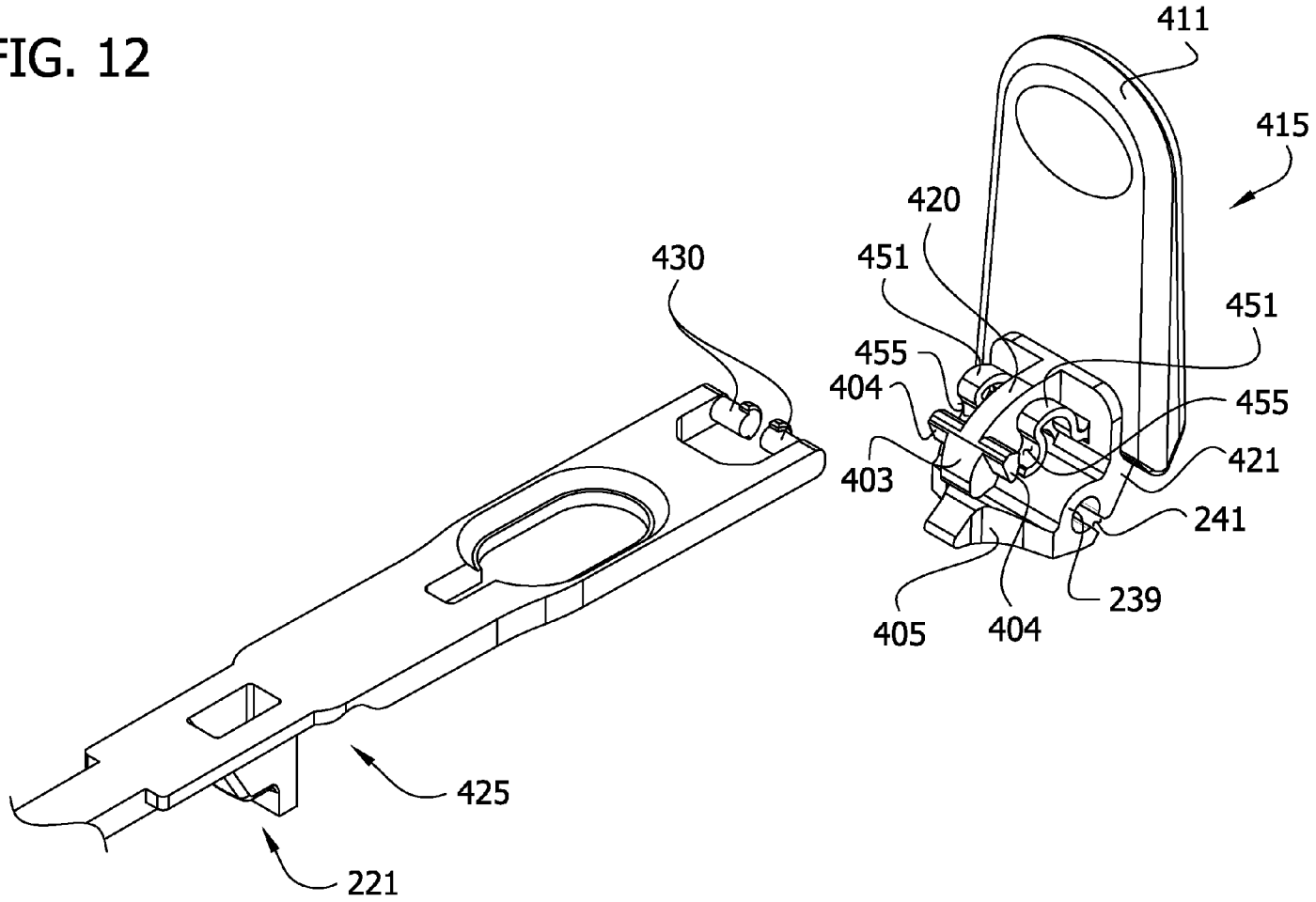
FIG. 12 is an enlarged perspective of an actuator and an end of a travel bar of the ring mechanism illustrated in FIGS. 10 and 11 just prior to connection therebetween.
Figure 13:
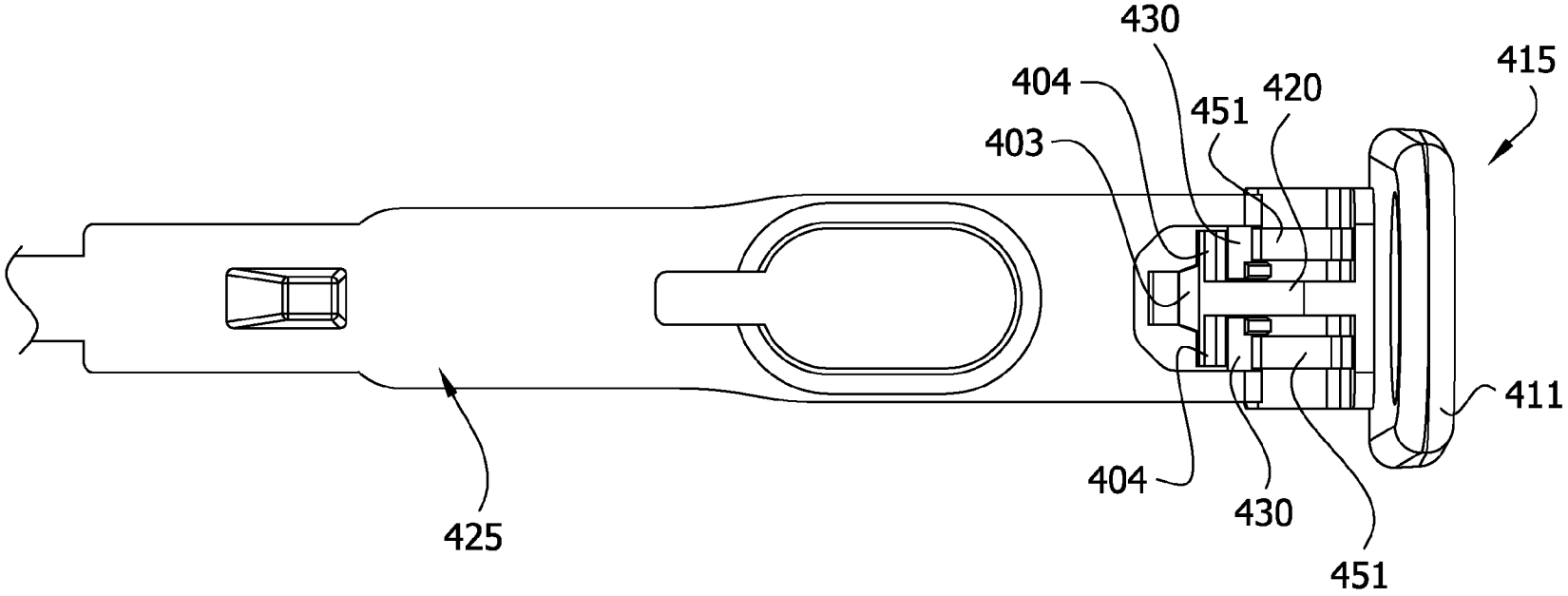
FIG. 13 is an enlarged top plan view of the actuator and end of the travel bar illustrated in FIG. 12 connected together.

FIGS. 8 and 9 illustrate a second embodiment of a ring mechanism, generally designated 301. Except as noted, the ring mechanism 301 is substantially the same as the ring mechanism 101 described above and illustrated in FIGS. 1-7C. The travel bar 325 in this ring mechanism 301 does not include a connector portion formed integrally with the locking portion 323. Instead, the locking portion 323 of the travel bar 325 is connected to the actuator 115 by a separate connector 327. As illustrated, in FIGS. 8 and 9, the connector 327 is a wire link. Opposing ends 333 of the wire link 327 are received in the recess 255 in the actuator 115 and perform in a manner analogous to the cross bar 233 of the ring mechanism 101 described above. Use of a separate wire link connector to connect the locking portion of a travel bar to an actuator is disclosed in greater detail in commonly-owned application Ser. No. 11/610,358 (Published as US 20080124166), which is hereby incorporated by reference, and need not be discussed in greater detail in this application.

A third embodiment of a ring mechanism, generally designated 401, is illustrated in FIGS. 10-14E. This embodiment is substantially identical to the ring mechanism 101 described above, except as noted. The closing arm 403 of the actuator 415 in this embodiment, includes a rib 420 connecting the closing arm to the actuator handle 411. The rib 420 enhances the stiffness of the closing arm 403. The rib 420 also splits the flexible arm into two separate flexible arms 451 extending generally from the actuator body 421. In the illustrated embodiment, the flexible arms 451 are substantially identical. The arms 451 are spaced from the rib 420 on opposite sides thereof to facilitate movement of the arms independently of the rib 420.

Figure 14A:
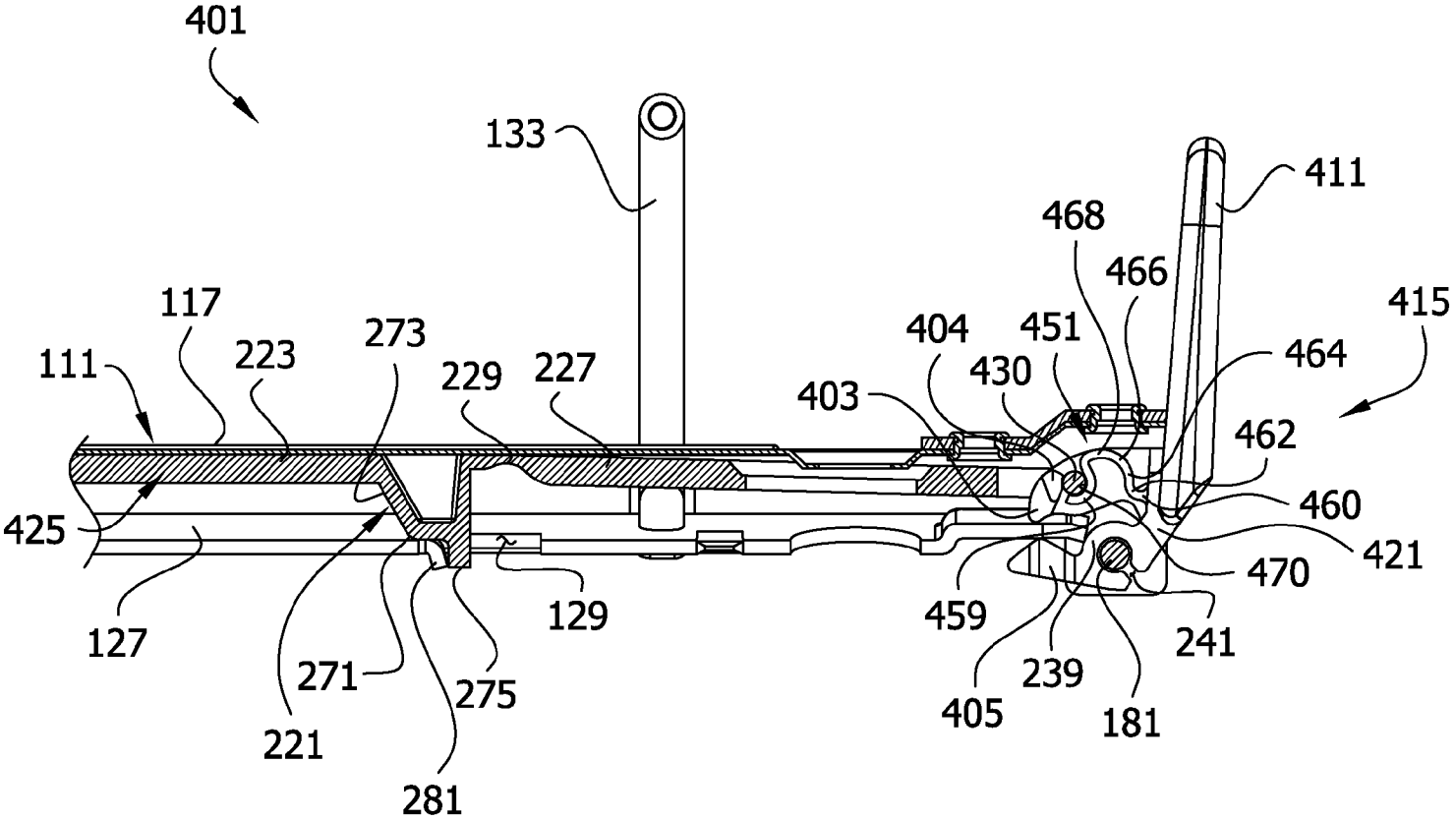
FIGS. 14A-14E illustrated a sequence in which the actuator of the ring mechanism illustrated in FIGS. 10-13 is used to open and close the rings.
Figure 14B:
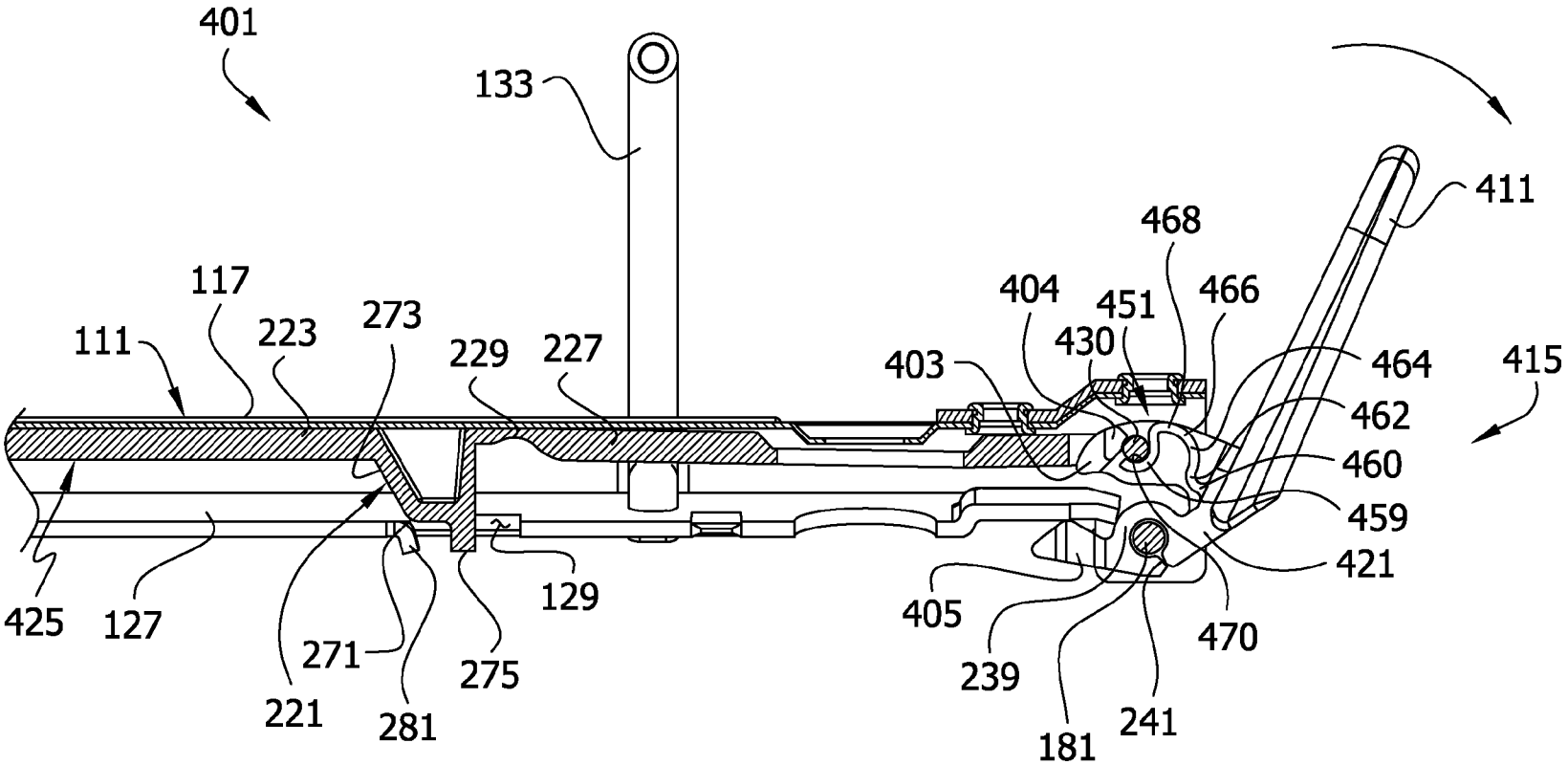
Figure 14C:
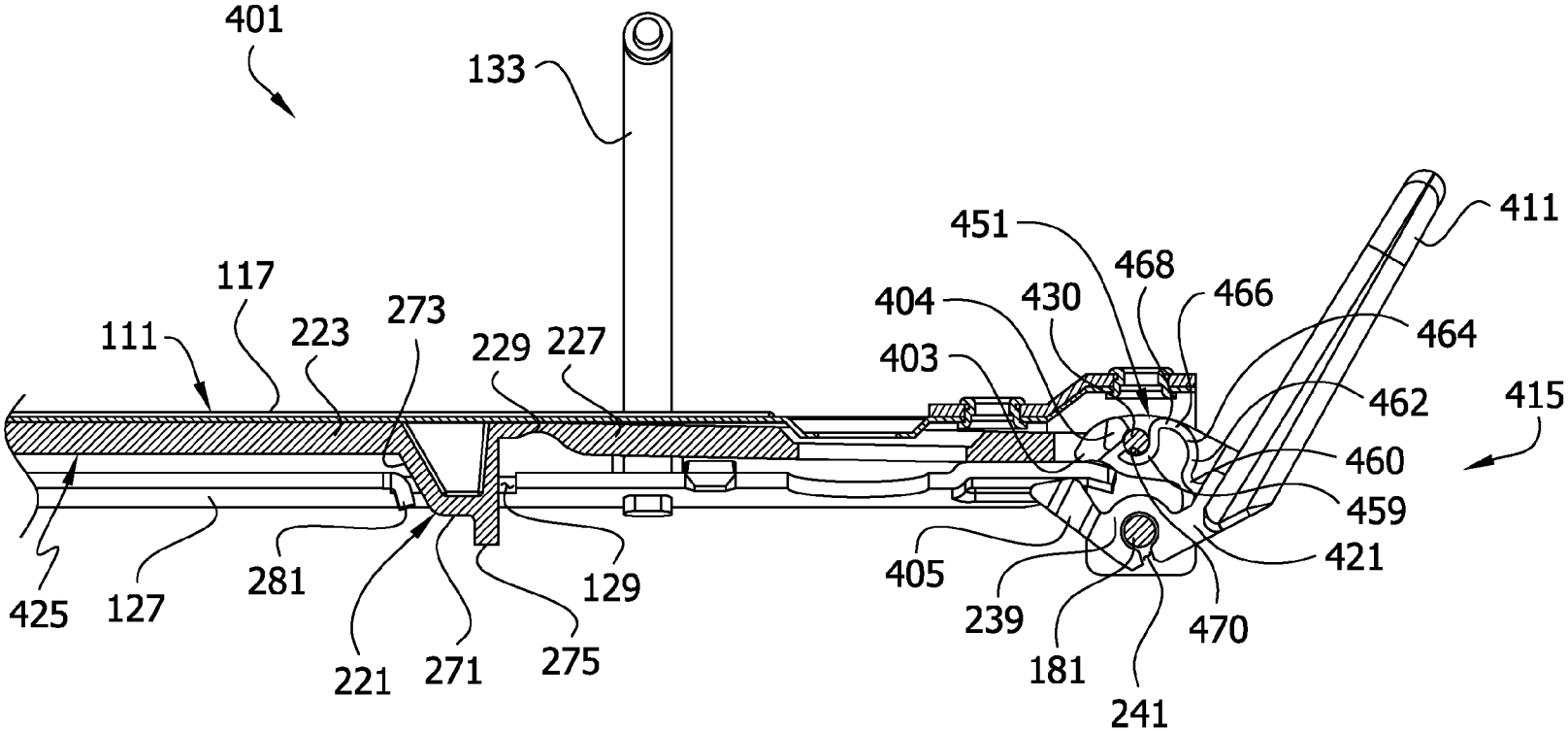
Figure 14D:
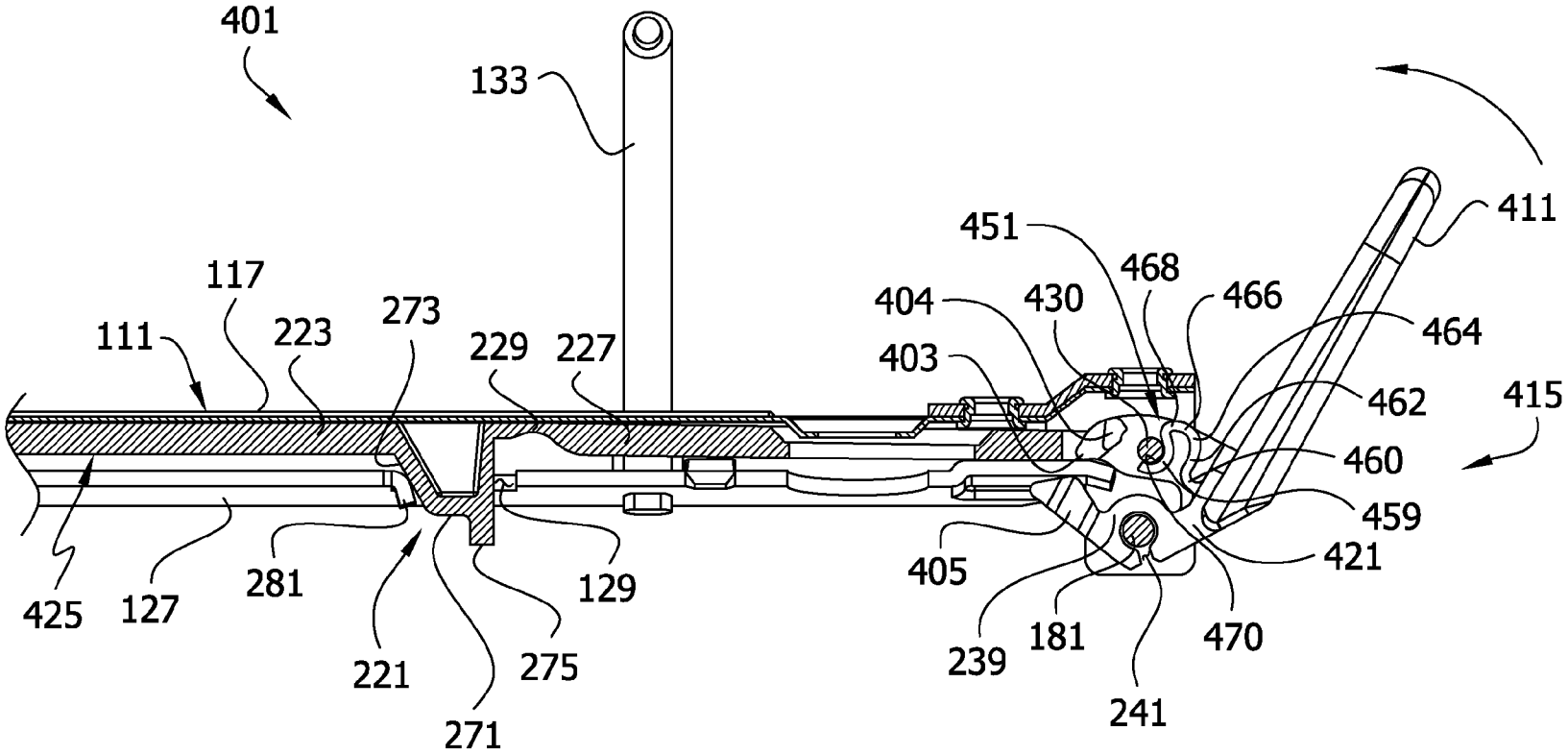
Figure 14E:
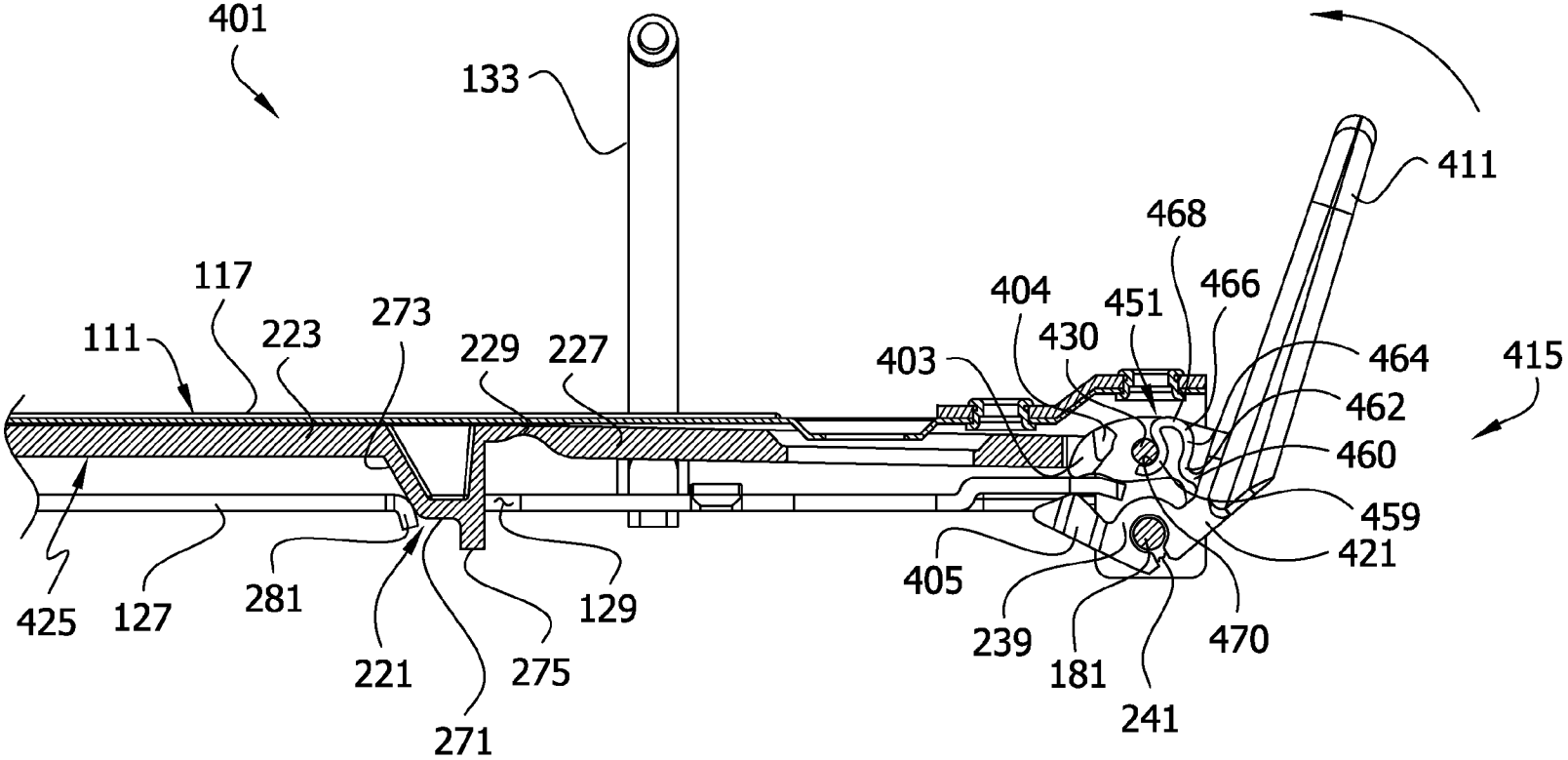
Figure 15:
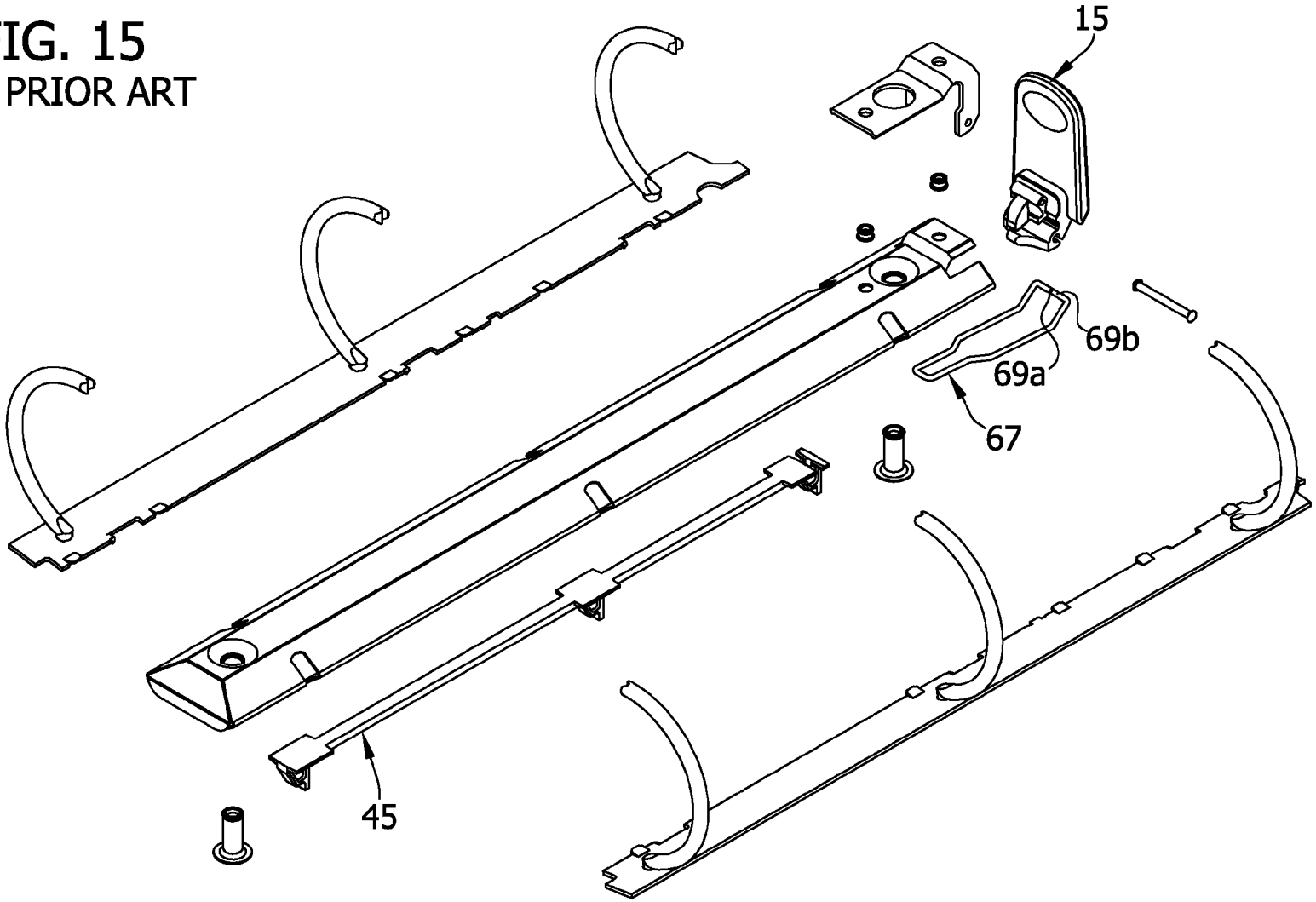
FIG. 15 PRIOR ART
FIGS. 15-18 illustrate a prior art ring mechanism.
Figure 16:
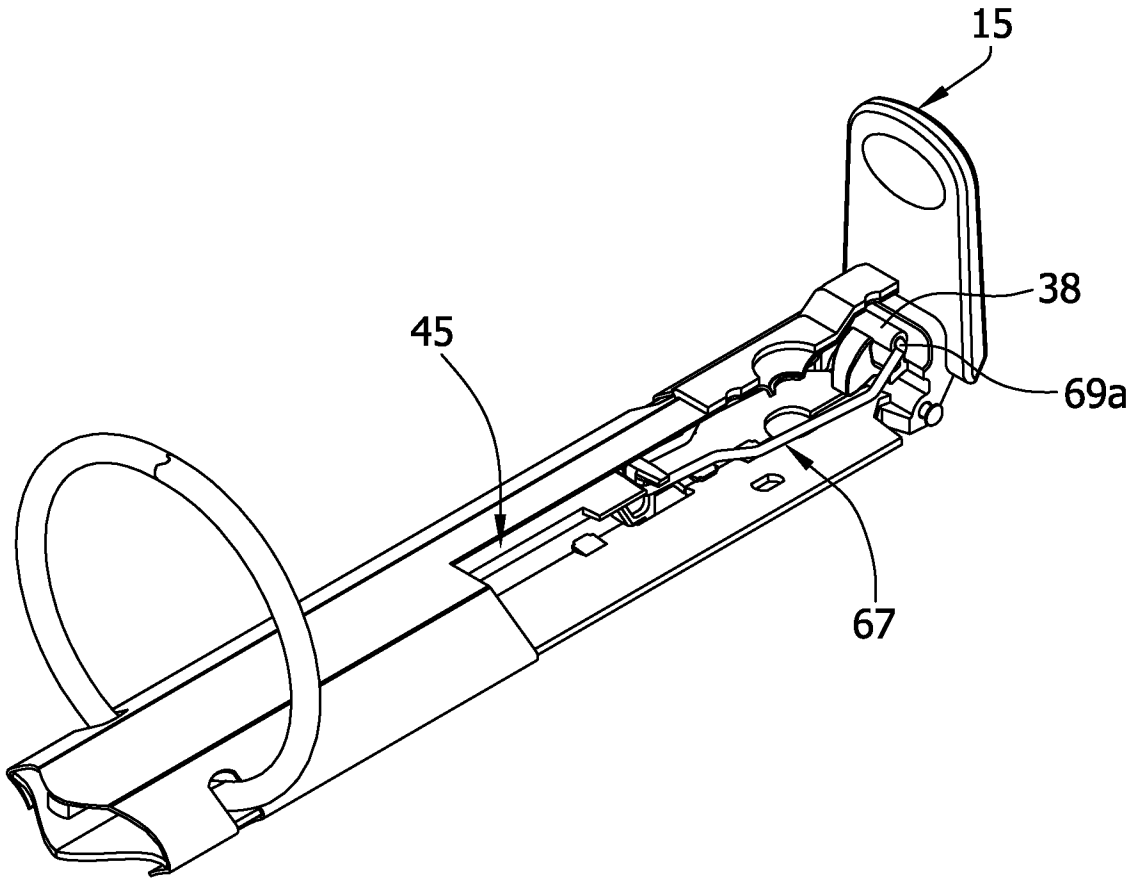
FIG. 16 PRIOR ART
Figure 17:
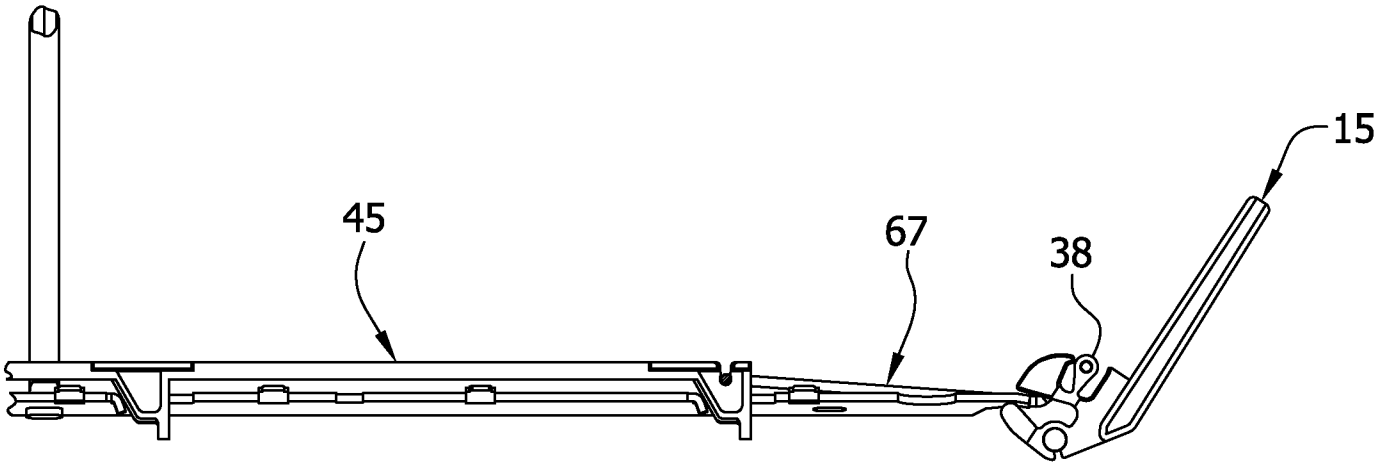
FIG. 17 PRIOR ART
Figure 18:
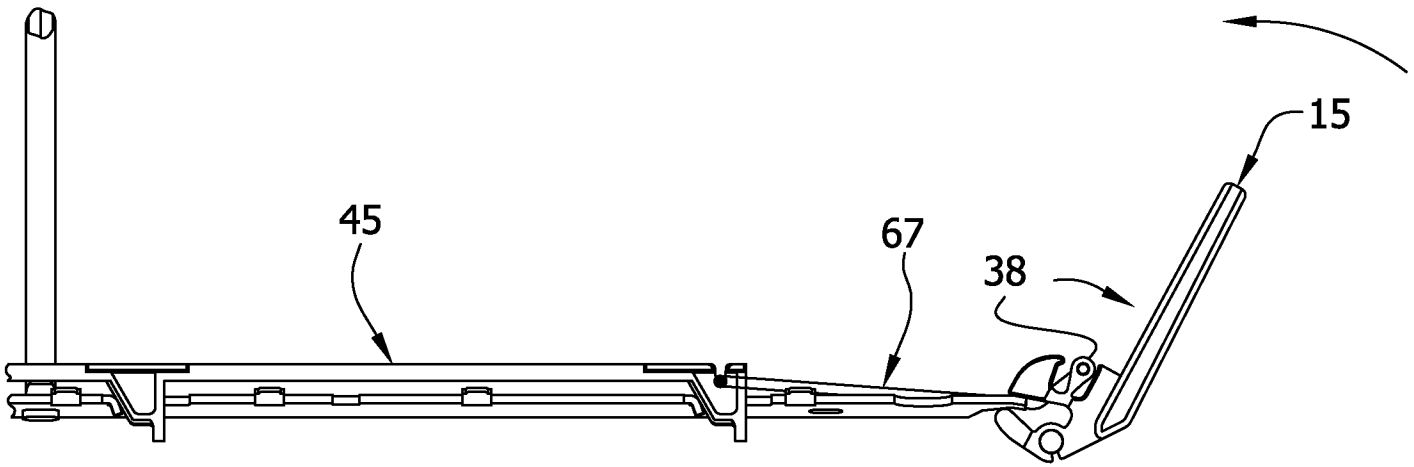
FIG. 18 PRIOR ART

As best illustrated in FIG. 14A, each flexible arm 451 in its undeformed state is attached at one end 460 to the body 421 of the actuator. The arm 451 curves upward at a first bend 462 relatively close to the attached end 460. The first bend 462 in the arm is a relatively sharp bend. The flexible arm 451 extends from the first bend 462 to an inflection point 464 between the first bend and a relatively broad gentle bend in the opposite direction extending up to an apex 468 of the flexible arm. On the opposite side of the apex 468, the flexible arm 451 has a sharp downward bend 461. A lower arm portion 459 extends from the sharp downward bend 461 to a free end 463 of the flexible arm. The lower arm portion 459 and sharp downward bend 461 are generally analogous to the lower arm portion 259 and end 261 of the upper arm portion 257 of the flexible arm 251 in the ring mechanism described above.

The travel bar 425 in this ring mechanism 401 has a pair of opposing ears 430 extending inward toward one another in place of the cross bar 233 described above. Fingers 404, which are suitably substantially rigid in comparison to the flexible arms 451, extend laterally from opposite sides of the rib 420. In contrast to the lower arm portion 259 described above, which has a generally flat inclined surface facing the cross bar 233, the lower arm portion 469 of each flexible arm 451 in this ring mechanism 401 has a concave surface facing a respective one of the fingers 404. Together the concave surfaces 470 of the flexible arms 451 and fingers 404 of the closing arm 403 define spaces 455 in which the arms 430 of the travel bar 425 may be captured by moving the travel bar during assembly of the ring mechanism in a manner analogous to the sequence illustrated in FIGS. 5A-5C. The closing arm 403 in this embodiment does not constrain downward movement of the end of the travel bar 425 relative to the actuator 415 because there is no part of the closing arm positioned to prevent the end of the travel bar falling out of the spaces 455. Instead, the concave surfaces 470 on the flexible arms 451 extend around the lower portion of the ears 430 at the end of the travel bar 425 an amount sufficient to prevent movement of the ears below the free end 463 of the flexible arms.

Operation of the ring mechanism 401 is similar to operation of the ring mechanism 101 described above, except as noted. During opening movement of the actuator 415, the fingers 404 pull the ears 430 of the travel bar 425 to move the travel bar 425 toward the non-locking position. During closing movement of the actuator 415 the flexible arms 451 push the ears 430 to move the travel bar 425 to the locking position. The flexible arms 451 deform to delay movement of the travel bar 425 from the pivoting movement of the hinge plates 127. In particular, the flexible arm is compressed at the apex 468 so the lower arm portion 459 moves toward the handle 411 of the actuator. The lower arm portion 459 also rotates about an axis generally coincident with the sharp bend 461. The rotational movement of the lower arm portion 459 produced by this deformation is in the same direction (e.g., counterclockwise as illustrated) as rotation of the actuator 415 during closing. The lower arm portions 459 of the flexible arms 451 also deform so the concave surfaces 470 (as well as the ears 430 at the end of the travel bar 425) move closer to the pivot axis (e.g., pivot pin 181) of the actuator 415 during closing. Thus, the actuator 415 sequences movement of the travel bar 425 and hinge plates 127 during closing in a manner that is similar to the actuator 115 described above. However, the closing arm 403 of this actuator 415 can be made stiffer and stronger than the closing arm 203 of the actuator 115 described above.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring mechanism for holding loose-leaf pages, the mechanism comprising:

an elongate housing;

rings for holding the loose-leaf pages, each ring including a first ring member and a second ring member, the first ring members being movable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator moveable relative to the housing to cause the pivoting motion of the hinge plates, the actuator being moveable between a first position in which the ring members are in the closed position and a second position in which the ring members are in the open position, the actuator comprising (i) a body; (ii) a closing arm extending from the body and positioned to pivot the hinge plates and move the rings to the closed position when the actuator moves from the second position to the first position; and (iii) an opening arm extending from the body and positioned to pivot the hinge plates and move the rings to the open position when the actuator moves from the first position to the second position; and a travel bar comprising a locking element, the travel bar being moveable between a locked position in which the locking element blocks pivoting movement of the hinge plates to move the rings from the closed position to the open position and an unlocked position in which the locking element permits pivoting movement of the hinge plates to open the rings, the actuator further comprising a flexible arm positioned to push the travel bar toward the locked position when the actuator moves from the second position to the first position, at least a portion of the flexible arm being adapted to deform when the actuator is moved from the second position to the first position, said deformation resulting in rotation of said portion of the flexible arm relative to the body of the actuator in a first direction, wherein movement of the actuator from the second position to the first position includes rotation of the actuator relative to the housing in said first direction.

2. A ring mechanism as set forth in claim 1 wherein the flexible arm is connected to the body of the actuator.

3. A ring mechanism as set forth in claim 1 wherein the actuator is mounted for pivoting movement relative to the housing about a pivot axis between the first and second positions.

4. A ring mechanism as set forth in claim 3 wherein said portion of the flexible arm has a free end and extends radially inward toward said pivot axis of the actuator to the free end.

5. A ring mechanism as set forth in claim 1 wherein the actuator defines a space and the travel bar has an end that is snapped into the space, the travel bar being captured in the space by the flexible arm.

6. A ring mechanism as set forth in claim 5 wherein the travel bar has arms extending longitudinally of the housing and a cross bar at the end extending between the arms, the cross bar being formed as one piece with the arms and extending through said space between the closing arm and the flexible arm from one side of the actuator to an opposite side of the actuator.

7. A ring mechanism as set forth in claim 6 wherein the travel bar and actuator are adapted so the cross bar can be inserted into said space during assembly of the ring mechanism by moving the cross bar relative to the actuator in a direction that is generally perpendicular to a longitudinal axis of the cross bar.

8. A ring mechanism as set forth in claim 6 wherein flexible arm is positioned to push against the cross bar when the actuator moves from the second position to the first position.

9. A ring mechanism as set forth in claim 5 wherein the end of the travel bar comprises opposing ears extending inward toward one another, the actuator further comprising a handle extending from the body and a rib extending from the closing arm to the handle, the rib being positioned between the opposing ears at the end of the travel bar.

10. A ring mechanism as set forth in claim 9 wherein the flexible arm is a first flexible arm, the actuator further comprising a second flexible arm, the first flexible arm being positioned on one side of the rib, the second flexible arm being position on an opposite side of the rib from the first flexible arm.

11. A ring mechanism as set forth in claim 10 wherein the first and second flexible arms are spaced from the rib for movement of the flexible arms independent of the rib.

12. A ring mechanism as set forth in claim 1 wherein the actuator is mounted for pivoting movement relative to the housing about a pivot axis and the flexible arm is adapted to move the end of the travel bar closer to the pivot axis during movement of the actuator from the second position to the first position.

13. A ring mechanism as set forth in claim 1 wherein the travel bar is formed as one piece and comprises a living hinge between the locking element and the actuator, the portion of the travel bar between the living hinge and the actuator comprising a connector portion adapted to convert movement of the actuator to substantially linear movement of the locking element.

14. A ring mechanism as set forth in claim 13 wherein the travel bar is adapted to be compressed no more than about 1 percent in length during movement of the actuator from the second position to the first position.

15. A ring mechanism as set forth in claim 1 wherein the actuator defines a generally channel shaped space having a top and an opening at the top, the flexible arm extending down into the space.

16. A ring mechanism as set forth in claim 15 wherein the travel bar comprises a connector portion connecting the locking element to the actuator, the flexible arm being adapted to receive at least a portion of the connector portion.

17. A ring mechanism as set forth in claim 1 in combination with a substrate, the ring mechanism being mounted on the substrate.

18. A ring mechanism for holding loose-leaf pages, the mechanism comprising:

an elongate housing;

rings for holding the loose-leaf pages, each ring including a first ring member and a second ring member, the first ring members being movable relative to the housing and the second ring members between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings;

first and second hinge plates supported by the housing for pivoting motion relative to the housing, said first ring members being mounted on the first hinge plate and moveable with the pivoting motion of the first hinge plate between the closed and open positions;

an actuator pivotable relative to the housing about a pivot axis to cause the pivoting motion of the hinge plates, the actuator being pivotable between a first position in which the ring members are in the closed position and a second position in which the ring members are in the open position, the actuator comprising (i) a body; (ii) a closing arm extending from the body and positioned to pivot the hinge plates and move the rings to the closed position when the actuator moves from the second position to the first position; (iii) an opening arm extending from the body and positioned to pivot the hinge plates and move the rings to the open position when the actuator moves from the first position to the second position; (iv) a handle extending from the body for use by a user to pivot the actuator between the first and second positions; and (v) a generally channel shaped space in the actuator, the channel shaped space opening radially outward of the actuator from the pivot axis; and a travel bar comprising a locking element, the travel bar being moveable by the pivoting movement of the actuator between a locked position in which the locking element blocks pivoting movement of the hinge plates to move the rings from the closed position to the open position and an unlocked position in which the locking element permits pivoting movement of the hinge plates to open the rings, wherein the travel bar has an end that is captured by the actuator in the channel shaped space, the travel bar and actuator being adapted so the end of the travel bar can be snapped into said channel shaped space during assembly of the ring mechanism by moving the travel bar relative to the actuator into said channel shaped space in a direction that is perpendicular to said pivot axis of the actuator as the end of the travel bar is received in said channel shaped space; and wherein the end of the travel bar comprises opposing ears extending inward toward one another, the actuator further comprising a rib extending from the closing arm to the handle, the rib being positioned between the opposing ears at the end of the travel bar.

19. A ring mechanism as set forth in claim 18 wherein the actuator is adapted to deform during movement of the actuator from the second position to the first position to delay movement of the travel bar from the pivoting movement of the hinge plates.

20. A ring mechanism as set forth in claim 18 wherein the travel bar is formed as one piece and comprises a living hinge between the locking element and the actuator, the portion of the travel bar between the living hinge and the actuator comprising an intermediate connector portion adapted to convert movement of the actuator to substantially linear movement of the locking element.

21. A ring mechanism as set forth in claim 20 wherein the travel bar is adapted to be compressed no more than about 1 percent in length during movement of the actuator from the second position to the first position.

* * * * *